US006158240A

United States Patent [19]

Low et al.

[11] Patent Number: 6,158,240

[45] Date of Patent: Dec. 12, 2000

[54] CONVERSION OF NORMALLY GASEOUS MATERIAL TO LIQUEFIED PRODUCT

[75] Inventors: William R. Low; Dunn M. Bailey, both of Bartlesville, Okla.

[73] Assignee: Phillips Petroleum Company, Bartlesville, Okla.

[21] Appl. No.: 09/177,727

[22] Filed: Oct. 23, 1998

[51] Int. Cl.[7] ..... F25J 1/02

[52] U.S. Cl. ..... 62/611

[58] Field of Search ..... 62/606, 611, 614

[56] References Cited

U.S. PATENT DOCUMENTS

| | | | |
|---|---|---|---|
| 3,581,511 | 6/1971 | Peck | 62/24 |
| 4,195,979 | 4/1980 | Martin | 62/26 |
| 4,680,041 | 7/1987 | DeLong | 62/11 |
| 5,669,234 | 9/1997 | Houser et al. | 62/612 |

OTHER PUBLICATIONS

The Standards of the Brazed Aluminum Plate–Fin Heat Exchanger Manufacturers' Association, First Edition (1994).

*Primary Examiner*—Henry Bennett
*Assistant Examiner*—Malik N. Drake
*Attorney, Agent, or Firm*—Gary L. Haag

[57] ABSTRACT

The inventive process and associated apparatus are ideally suited for the small-scale liquefaction of natural gas. The current invention provides a methodology and apparatus for the liquefaction of normally gaseous material, most notably natural gas, which reduces both the number of process vessels required and also the associated space requirements over convention apparatus while resulting in only a slight decrease in process efficiency.

67 Claims, 3 Drawing Sheets

CONVERSION OF NORMALLY GASEOUS MATERIAL TO LIQUEFIED PRODUCT

The inventive methodology and associated apparatus relates to the liquefaction of normally gaseous material, most notably natural gas, and results in a reduction in the number of process vessels and associated space requirements over conventional technologies while incurring only a small decrease in process efficiency. The invention is particularly applicable to the liquefaction of natural gas at the small to intermediate scale where certain economies of scale associated with world-scale plants are lost or become much less significant.

BACKGROUND

Cryogenic liquefaction of normally gaseous materials is utilized for the purposes of component separation, purification, storage and for the transportation of said components in a more economic and convenient form. Most such liquefaction systems have many operations in common, regardless of the gases involved, and consequently, have many of the same problems. One problem commonly encountered is the number of process vessels and the costs and associated complexities attributable to the operation and maintenance of such vessels. These problems become more significant as world-scale liquefaction processes are scaled down and economies of scale are lost. Although the present invention will be described with specific reference to the processing of natural gas, the invention is applicable to the processing of normally gaseous materials in other systems wherein similar problems are encountered.

It is common practice in the art of processing natural gas to subject the gas to cryogenic treatment to separate hydrocarbons having a molecular weight greater than methane ($C_2$+) from the natural gas thereby producing a pipeline gas predominating in methane and a $C_2$+ stream useful for other purposes. Frequently, the $C_2$+ stream will be separated into individual component streams, for example, $C_2$, $C_3$, $C_4$ and $C_5$+.

It is also common practice to cryogenically treat natural gas to liquefy the same for transport and storage. The primary reason for the liquefaction of natural gas is that liquefaction results in a volume reduction of about 1/600, thereby making it possible to store and transport the liquefied gas in containers of more economical and practical design. For example, when gas is transported by pipeline from the source of supply to a distant market, it is desirable to operate the pipeline under a substantially constant and high load factor. Often the deliverability or capacity of the pipeline will exceed demand while at other times the demand may exceed the deliverability of the pipeline. In order to shave off the peaks where demand exceeds supply, it is desirable to store the excess gas in such a manner that it can be delivered when the supply exceeds demand, thereby enabling future peaks in demand to be met with material from storage. One practical means for doing this is to convert the gas to a liquefied state for storage and to then vaporize the liquid as demand requires.

Liquefaction of natural gas is of even greater importance in making possible the transport of gas from a supply source to market when the source and market are separated by great distances and a pipeline is not available or is not practical. This is particularly true where transport must be made by ocean-going vessels. Ship transportation in the gaseous state is generally not practical because appreciable pressurization is required to significantly reduce the specific volume of the gas which in turn requires the use of more expensive storage containers.

In order to store and transport natural gas in the liquid state, the natural gas is preferably cooled to −240° F. to −260° F. where it possesses a near-atmospheric vapor pressure. Numerous systems exist in the prior art for the liquefaction of natural gas or the like in which gas is liquefied by sequentially passing the gas at an elevated pressure through a plurality of cooling stages whereupon the gas is cooled to successively lower temperatures until the liquefaction temperature is reached. Cooling is generally accomplished by heat exchange with one or more refrigerants such as propane, propylene, ethane, ethylene, and methane or a combination of one or more of the preceding. In the art, the refrigerants are frequently arranged in a cascaded manner and each refrigerant is employed in a closed refrigeration cycle. Further cooling of the liquid is possible by expanding the liquefied natural gas to atmospheric pressure in one or more expansion stages. In each stage, the liquefied gas is flashed to a lower pressure thereby producing a two-phase gas-liquid mixture at a significantly lower temperature. The liquid is recovered and may again be flashed. In this manner, the liquefied gas is further cooled to a storage or transport temperature suitable for liquefied gas storage at near-atmospheric pressure. In this expansion to near-atmospheric pressure, some additional volumes of liquefied gas are flashed. The flashed vapors from the expansion stages are generally collected and recycled for liquefaction or utilized as fuel gas for power generation.

As previously noted, the present invention concerns the arrangement/selection of apparatus and associated process methodologies whereby the number of process vessels in each closed refrigeration cycle is significantly reduced. This factor becomes very important as the process is downsized (i.e., cooling duty in each cycle is reduced) whereupon economies of scale are lost. The invention results in both a reduction in the number of vessels and associated space requirements thereby reducing costs while incurring a relatively small reduction in process efficiency.

SUMMARY OF THE INVENTION

It is an object of this invention to reduce the number of process vessels required for liquefying normally gaseous material.

It is another object of this invention to reduce the space requirements of a process for liquefying normally gaseous material.

It is still yet another object of this invention to develop a process methodology and associated apparatus for liquefying normally gaseous material which is less capital intensive than alternative liquefaction methodologies.

In one embodiment of the invention, a normally gaseous stream is cooled and partially condensed by a process comprising the steps of (a) flowing said normally gaseous stream and a refrigerant stream through one or more brazed aluminum plate fin heat exchange sections wherein said streams are in indirect heat exchange with and flow countercurrent to one or more refrigeration streams wherein said one or more refrigeration streams are formed by (i) removing a sidestream from the refrigerant stream or portion thereof produced from one of said plate fin heat exchange sections, (ii) reducing the pressure of the sidestream thereby generating a refrigeration stream, and (iii) flowing said refrigeration stream to the heat exchange section from which said refrigerant stream of (i) was produced whereupon said refrigeration stream becomes one of said refrigeration stream of (a); (b) separately flowing the refrigerant stream from the last heat exchange section of (a) through a brazed aluminum plate fin heat exchange section wherein said stream is in indirect heat exchange with and flow countercurrent to a vapor refrigerant stream; (c) reducing the pressure of the refrigerant stream from the heat exchange section of step (b); (d) employing said stream of step (c) as a cooling agent on the kettle-side of a core-in-kettle heat exchanger thereby producing a vapor refrigerant stream; (e) warming the vapor refrigerant stream of (d) by flowing through at least the plate fin heat exchange section of (b); (f) compressing the refrigeration streams of step (a) and the warmed vapor refrigerant stream of step (e); (g) cooling the compressed stream of step (f) thereby producing the refrigerant stream of step (a); and (h) flowing the normally gaseous stream from step (a) through the core side of the core-in-kettle heat exchanger thereby producing a liquid-bearing stream.

In another embodiment, two or more of the plate fin heat exchanger sections in the previous embodiment are contained in a single brazed aluminum plate fin heat exchanger.

In yet another embodiment, the invention is comprised of an apparatus for performing the above-cited process.

DESCRIPTION OF THE PREFERRED EMBODIMENTS

Figure 1:
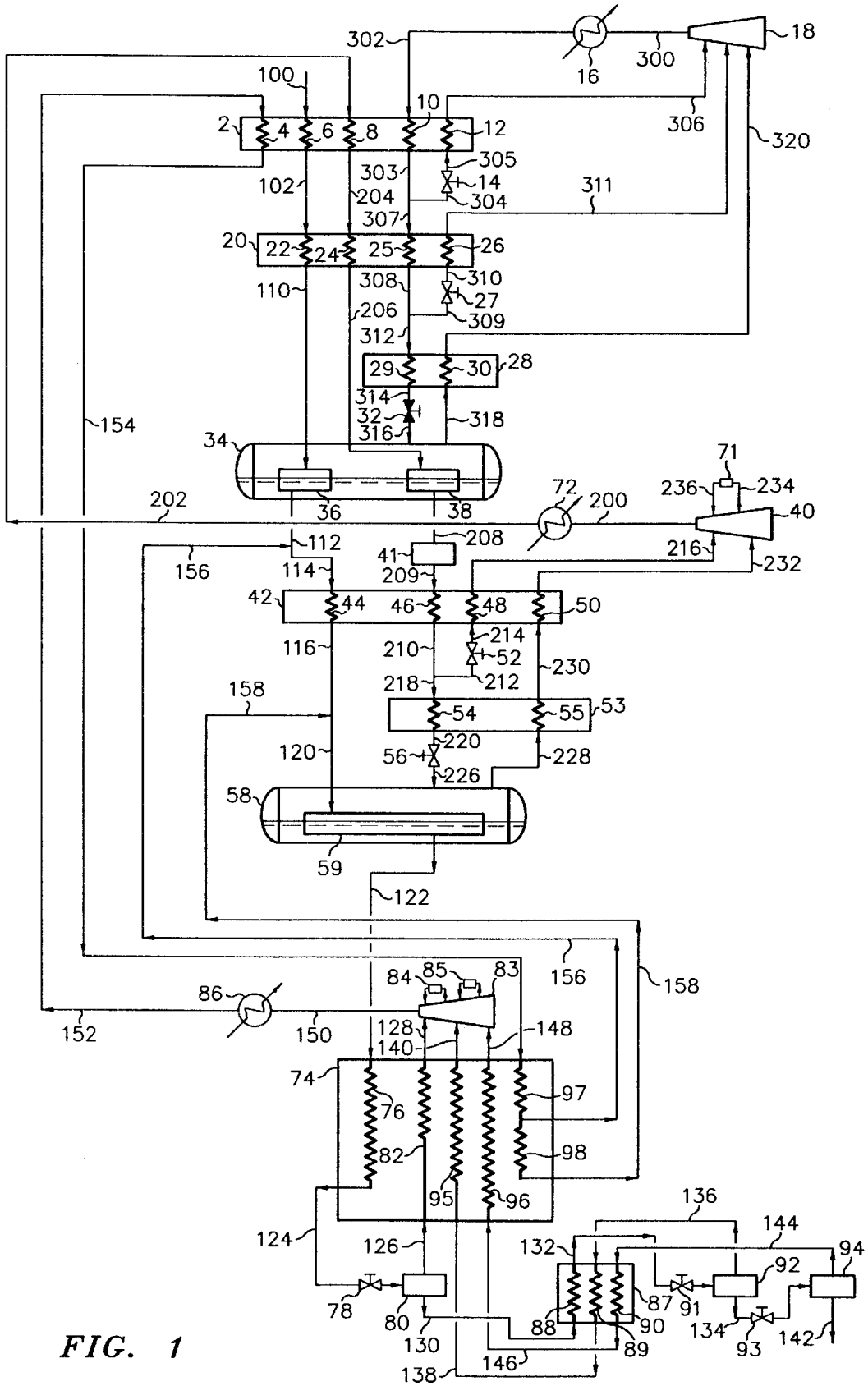
FIG. 1 is a simplified flow diagram of a cryogenic LNG production process which illustrates the methodology and apparatus of the present invention.

Because the processing of a natural gas stream is illustrative of the cooling of a normally gaseous material wherein preselected components are frequently removed from said stream and at least a portion of the stream liquefied and because this application is a preferred embodiment of the present invention, the following description with reference to the drawings will be confined to the processing of a natural gas stream. However, it is to be understood that the present invention is not confined to the processing of natural gas nor to the separation of components from a gas or the liquefaction of a gas, but relates broadly to the cooling of a normally gaseous material in general whereupon liquid product is produced and particularly, the multi-stage cooling of a normally gaseous material whereupon a liquid product is produced.

Natural Gas Stream Liquefaction

In the processing of natural gas, pretreatment steps are routinely employed for removing undesirable components such as acid gases, mercaptans, mercury and moisture from the natural gas feed stream delivered to the facility. The composition of this gas stream may vary significantly. As used herein, a natural gas stream is any stream principally comprised of methane which originates in major portion from a natural gas feed stream; for example a stream containing at least 85% methane by volume, with the balance being ethane, higher hydrocarbons, nitrogen, carbon dioxide and a minor amounts of other contaminants such as mercury, hydrogen sulfide, mercaptans. The pretreatment steps may be separate steps located either upstream of the cooling cycles or located downstream of one of the early stages of cooling in the initial cycle. The following is a non-inclusive listing of some of the available means which are readily available to one skilled in the art. Acid gases and to a lesser extent mercaptans are routinely removed via a sorption process employing an aqueous amine-bearing solution. This treatment step is generally performed upstream of the cooling stages employed in the initial cycle. A major portion of the water is routinely removed as a liquid via two-phase gas-liquid separation following gas compression and cooling upstream of the initial cooling cycle and also downstream of the first cooling stage in the initial cooling cycle. Mercury is routinely removed via mercury sorbent beds. Residual amounts of water and acid gases are routinely removed via the use of properly selected sorbent beds such as regenerable molecular sieves. Processes employing sorbent beds are generally located downstream of the first cooling stage in the initial cooling cycle.

One of the most efficient and effective methodologies for natural gas liquefaction is a cascade-type operation and this type in combination with expansion-type cooling. Also, since methods for the production of liquefied natural gas (LNG) include the separation of hydrocarbons of molecular weight greater than methane as a first part thereof, a description of a plant for the cryogenic production of LNG effectively describes a similar plant for removing $C_2$+ hydrocarbons from a natural gas stream.

In the preferred embodiment which employs a cascaded refrigerant system, the invention concerns the sequential cooling of a natural gas stream at an elevated pressure, for example about 650 psia, by sequentially cooling the gas stream by passage through a multistage propane cycle, a multistage ethane or ethylene cycle and either (a) a closed methane cycle followed by a single- or a multistage expansion cycle to further cool the same and reduce the pressure to near-atmospheric or (b) an open-end methane cycle which utilizes a portion of the feed gas as a source of methane and which includes therein a multistage expansion cycle to further cool the same and reduce the pressure to near-atmospheric pressure. In the sequence of cooling cycles, the refrigerant having the highest boiling point is utilized first followed by a refrigerant having an intermediate boiling point and finally by a refrigerant having the lowest boiling point.

The natural gas stream is generally delivered to the liquefaction process at an elevated pressure or is compressed to an elevated pressure, that being a pressure greater than 500 psia, preferably about 500 to about 900 psia, still more preferably about 550 to about 675 psia, still yet more preferably about 575 to about 650 psia, and most preferably about 600 psia. The stream temperature is typically near ambient to slightly above ambient. A representative temperature range being 60° F. to 120° F.

As previously noted, the natural gas stream at this point is cooled in a plurality of multistage (for example, three) cycles or steps by indirect heat exchange with a plurality of refrigerants, preferably three. The overall cooling efficiency for a given cycle improves as the number of stages increases but this increase in efficiency is accompanied by corresponding increases in net capital cost and process complexity. The feed gas is preferably passed through an effective number of refrigeration stages, nominally two, preferably two to four, and more preferably three stages, in the first closed refrigeration cycle utilizing a relatively high boiling refrigerant. Such refrigerant is preferably comprised in major portion of propane, propylene or mixtures thereof, more preferably propane, and most preferably the refrigerant consists essentially of propane. Thereafter, the processed feed gas flows through an effective number of stages, nominally two, preferably two to four, and more preferably two or three, in a second closed refrigeration cycle in indirect heat exchange with a refrigerant having a lower boiling point. Such refrigerant is preferably comprised in major portion of ethane, ethylene or mixtures thereof, more preferably ethylene, and most preferably the refrigerant consists essentially of ethylene. Each of the above-cited cooling stages for each refrigerant comprises a separate cooling zone.

Generally, the natural gas feed stream will contain such quantities of $C_2$+ components so as to result in the formation of a $C_2$+ rich liquid in one or more of the cooling stages. This liquid is removed via gas-liquid separation means, preferably one or more conventional gas-liquid separators. Generally, the sequential cooling of the natural gas in each stage is controlled so as to remove as much as possible of the $C_2$ and higher molecular weight hydrocarbons from the gas to produce a first gas stream predominating in methane and a second liquid stream containing significant amounts of ethane and heavier components. An effective number of gas/liquid separation means are located at strategic locations downstream of the cooling zones for the removal of liquids streams rich in $C_2$+ components. The exact locations and number of gas/liquid separation means will be dependant on a number of operating parameters, such as the $C_2$+ composition of the natural gas feed stream, the desired BTU content of the final product, the value of the $C_2$+ components for other applications and other factors routinely considered by those skilled in the art of LNG plant and gas plant operation. The $C_2$+ hydrocarbon stream or streams may be demethanized via a single stage flash or a fractionation column. In the former case, the methane-rich stream can be repressurized and recycled or can be used as fuel gas. In the latter case, the methane-rich stream can be directly returned at pressure to the liquefaction process. The $C_2$+ hydrocarbon stream or streams or the demethanized $C_2$+ hydrocarbon stream may be used as fuel or may be further processed such as by fractionation in one or more fractionation zones to produce individual streams rich in specific chemical constituents (ex., $C_2$, $C_3$, $C_4$ and $C_5$+). In the last stage of the second cooling cycle, the gas stream which is predominantly methane (typically greater than 95 mol % methane and more typically greater than 97 mol % methane) is condensed (i.e., liquefied) in major portion, preferably in its entirety.

The liquefied natural gas stream is then further cooled in a third step by one of two embodiments. In one embodiment, the liquefied natural gas stream is further cooled by indirect heat exchange with a third closed refrigeration cycle wherein the condensed gas stream is subcooled via passage through an effective number of stages, nominally 2; preferably 2 to 4; and most preferably 3 wherein cooling is provided via a third refrigerant having a boiling point lower than the refrigerant employed in the second cycle. This refrigerant is preferably comprised in major portion of methane, still more preferably is greater than 90 mol % methane, and most preferably consists essentially of methane. In the second and preferred embodiment which employs an open methane refrigeration cycle, the liquefied natural gas stream is subcooled via indirect heat exchange with flash gases in a main methane economizer in a manner to be described later.

In the fourth step, the liquefied gas is further cooled by expansion and separation of the flash gas from the cooled liquid. In a manner to be described, nitrogen removal from the system and the condensed product is accomplished either as part of this step or in a separate succeeding step. A key factor distinguishing the closed cycle from the open cycle is the initial temperature of the liquefied stream prior to flashing to near-atmospheric pressure, the relative amounts of flashed vapor generated upon said flashing, and the disposition of the flashed vapors. Whereas the majority of the flash vapor is recycled to the methane compressors in the open-cycle system, the flashed vapor in a closed-cycle system is generally utilized as a fuel.

In the fourth step in either the open- or closed-cycle methane systems, the liquefied product is cooled via at least one, preferably two to four, and more preferably three expansions where each expansion employs either Joule-Thomson expansion valves or hydraulic expanders followed by a separation of the gas-liquid product with a separator. As used herein, the term "hydraulic expands" is not limited to an expander which receives and produces liquid streams but is inclusive of expanders which receive a predominantly liquid-phase stream and produce a two-phase (gas/liquid) stream. When a hydraulic expander is employed and properly operated, the greater efficiencies associated with the recovery of power, a greater reduction in stream temperature, and the production of less vapor during the expansion step will frequently be cost-effective even in light of increased capital and operating costs associated with the expander. In one embodiment employed in the open-cycle system, additional cooling of the high pressure liquefied product prior to flashing is made possible by first flashing a portion of this stream via one or more hydraulic expanders and then via indirect heat exchange means employing said flashed stream to cool the high pressure liquefied stream prior to flashing. The flashed product is then recycled via return to an appropriate location, based on temperature and pressure considerations, in the open methane cycle.

When the liquid product entering the fourth cycle is at the preferred pressure of about 600 psia, representative flash pressures for a three stage flash process are about 190, 61 and 14.7 psia. In the open-cycle system, vapor flashed or fractionated in the nitrogen separation step to be described and that flashed in the expansion flash steps are utilized as cooling agents in the third step or cycle which was previously mentioned. In the closed-cycle system, the vapor from the flash stages may also be employed as a cooling agent prior to either recycle or use as fuel. In either the open- or closed-cycle system, flashing of the liquefied stream to near atmospheric pressure will produce an LNG product possessing a temperature of −240° F. to −260° F.

To maintain the BTU content of the liquefied product at an acceptable limit when appreciable nitrogen exists in the feed stream, nitrogen must be concentrated and removed at some location in the process. Various techniques for this purpose are available to those skilled in the art. The following are examples. When an open methane cycle is employed and nitrogen concentration in the feed is low, typically less than about 1.0 vol %, nitrogen removal is generally achieved by removing a small side stream at the high pressure inlet or outlet port at the methane compressor. For a closed cycle at nitrogen concentrations of up to 1.5 vol. % in the feed gas, the liquefied stream is generally flashed from process conditions to near-atmospheric pressure in a single step, usually via a flash drum. The nitrogen-bearing flash vapors are then generally employed as fuel gas for the gas turbines which drive the compressors. The LNG product which is now at near-atmospheric pressure is routed to storage. When the nitrogen concentration in the inlet feed gas is about 1.0 to about 1.5 vol % and an open-cycle is employed, nitrogen can be removed by subjecting the liquefied gas stream from the third cooling cycle to a flash step prior to the fourth cooling step. The flashed vapor will contain an appreciable concentration of nitrogen and may be subsequently employed as a fuel gas. A typical flash pressure for nitrogen removal at these concentrations is about 400 psia. When the feed stream contains a nitrogen concentration of greater than about 1.5 vol % and an open or closed cycle is employed, the flash step may not provide sufficient nitrogen removal. In such event, a nitrogen rejection column will be employed from which is produced a nitrogen rich vapor stream and a liquid stream. In a preferred embodiment which employs a nitrogen rejection column, the high pressure liquefied methane stream to the methane economizer is split into a first and second portion. The first portion is flashed to approximately 400 psia and the two-phase mixture is fed as a feed stream to the nitrogen rejection column. The second portion of the high pressure liquefied methane stream is further cooled by flowing through a methane economizer to be described later, it is then flashed to 400 psia, and the resulting two-phase mixture or the liquid portion thereof is fed to the upper section of the column where it functions as a reflux stream reflux. The nitrogen-rich vapor stream produced from the top of the nitrogen rejection column will generally be used as fuel. The liquid stream produced from the bottom of the column is then fed to the first stage of methane expansion.

Refrigerative Cooling for Natural Gas Liquefaction

Critical to the liquefaction of natural gas in a cascaded process is the use of one or more refrigerants for transferring heat energy from the natural gas stream to the refrigerant and ultimately transferring said heat energy to the environment. In essence, the refrigeration system functions as a heat pump by removing thermal energy from the natural gas stream as the stream is progressively cooled to lower and lower temperatures. In so doing, the thermal energy removed from the natural gas stream is ultimately rejected (pumped) to the environment via energy exchange with one or more refrigerants.

The liquefaction process employs several types of cooling which include but are not limited to (a) indirect heat exchange, (b) vaporization and (c) expansion or pressure reduction. A key aspect of this invention is the manner in which indirect heat exchange is employed. Indirect heat exchange, as used herein, refers to a process wherein the refrigerant or cooling agent cools the substance to be cooled without actual physical contact between the refrigerating agent and the substance to be cooled. Specific examples include heat exchange undergone in a tube-and-shell heat exchanger, a core-in-kettle heat exchanger, and a brazed aluminum plate-fin heat exchanger. The current invention is distinguished over conventional methodologies by the novel and strategic use of brazed aluminum plate-fin heat exchangers in place of certain of the core-in-kettle heat exchangers thereby resulting in a reduction in the number of process vessels and associated space requirements while incurring only a relatively small decrease in process efficiency. As previously noted, these factors become increasingly more important as the process is downsized and economies of scale are lost for certain of the process vessels.

A second form of cooling which may be employed is vaporization cooling. Vaporization cooling refers to the cooling of a substance by the evaporation or vaporization of a portion of the substance with the system maintained at or near a constant pressure. Thus during vaporization cooling, the portion of the substance which evaporates absorbs heat from the portion of the substance which remains in a liquid state and hence, cools the liquid portion.

The third means of cooling which may be employed is expansion or pressure reduction cooling. Expansion or pressure reduction cooling refers to cooling which occurs when the pressure of a gas-, liquid- or a two-phase system is decreased by passing through a pressure reduction means. In one embodiment, this expansion means is a Joule-Thomson expansion valve. In another embodiment, the expansion means is a hydraulic expander or a gas expander. Because expanders recover work energy from the expansion process, lower process stream temperatures are possible upon expansion.

In the discussion and drawings to follow, the discussions or drawings may depict the expansion of a refrigerant by flowing through a throttle valve followed by a subsequent separation of gas and liquid portions on the kettle-side of a core-in-kettle heat exchanger. In an alternative embodiment, the throttle or expansion valve may not be a separate item connected by conduit to the core-in-kettle heat exchanger but rather an integral part of the core-in-kettle heat exchanger (i.e., the flash or expansion occurs upon entry of the liquefied refrigerant into the kettle-side of the core-in-kettle heat exchanger). Additionally, multiple streams may be cooled in a single core-in-kettle heat exchanger by the placement of multiple cores in a single kettle. The drawings and discussions may also address separating or splitting means wherein a given stream is partitioned into two or more streams. Such means for separating or splitting a stream are inclusive of those means routinely employed by those skilled in the art and include but are not limited to t's, y's and other piping arrangements with associated flow control mechanisms routinely employed in the splitting or separating of such streams and the employment of vessels possessing at least one inlet port and two or more outlet ports and associated flow control mechanisms routinely employed by those skilled in the art.

In the first cooling cycle in a cascaded cooling process, cooling is provided by the compression of a higher boiling point gaseous refrigerant, preferably propane, to a pressure where it can be liquefied by indirect heat transfer with a heat transfer medium which ultimately employs the environment as a heat sink, that heat sink generally being the atmosphere, a fresh water source, a salt water source, the earth or two or more of the preceding. The condensed refrigerant then undergoes one or more steps of expansion cooling via suitable expansion means thereby producing two-phase mixtures possessing significantly lower temperatures which are employed as cooling agents, also referred to herein as refrigeration streams. In the first cooling cycle, the refrigeration stream cools and condenses at least the second cycle refrigerant stream (a normally gaseous stream) and cools one or more methane-rich gas streams (ex., the natural gas stream).

In a similar manner in the second cooling cycle of a cascaded cooling process, cooling is provided by the compression of a refrigerant having a boiling point less than the refrigerant in the first cycle, preferably ethane or ethylene, most preferably ethylene, to a pressure where it is subsequently liquefied via contact with among other cooling mediums, the refrigerating agent from the first cycle. The condensed refrigerant stream then undergoes one or more steps of expansion cooling via suitable expansion means thereby producing two-phase mixtures possessing significantly lower temperatures which are employed as cooling agents, also referred to herein as refrigeration streams. These cooling agents or refrigeration streams are then employed to cool and at least partially condensed, preferably condense in major portion, at least one methane-rich gas stream.

When employing a three refrigerant cascaded closed cycle system, the refrigerant in the third cycle is compressed in a stagewise manner, preferably though optionally cooled via indirect heat transfer to an environmental heat sink (i.e., inter-stage and/or post-cooling following compression) and then cooled by indirect heat exchange with either all or selected cooling stages in the first and second cooling cycles which preferably employ propane and ethylene as respective refrigerants. Preferably, this stream is contacted in a sequential manner with each progressively colder stage of refrigeration in the first and second cooling cycles, respectively.

In an open-cycle cascaded refrigeration system such as that illustrated in FIG. 1, the first and second cycles are operated in a manner analogous to that set forth for the closed cycle. However, the open methane cycle system is readily distinguished from the conventional closed refrigeration cycles. As previously noted in the discussion of the fourth step, a significant portion of the liquefied natural gas stream (i.e., methane-rich gas stream) originally present at elevated pressure is cooled to approximately −260° F. by expansion cooling in a stepwise manner to near-atmospheric pressure. In each step, significant quantities of methane-rich vapor at a given pressure are produced. Each vapor stream preferably undergoes significant heat transfer in methane economizers and is preferably returned to the inlet port of the open methane cycle compressor for the stage of interest at near-ambient temperature. In the course of flowing through the methane economizers, the flashed vapors are contacted with warmer streams in a countercurrent manner and in a sequence designed to maximize the cooling of the warmer streams. The pressure selected for each stage of expansion cooling is such that for each stage, the volume of gas generated plus the compressed volume of vapor from the adjacent lower stage results in efficient overall operation of the open methane cycle multi-stage compressor. Interstage cooling and cooling of the final compressed gas is preferred and preferably accomplished via indirect heat exchange with one or more cooling agents directly coupled to an environmental heat sink. The compressed methane-rich stream is then further cooled via indirect heat exchange with refrigerant in the first and second cycles, preferably all stages associated with the refrigerant employed in the first cycle, more preferably the first two stages and most preferably, only the first stage. The cooled methane-rich stream is further cooled via indirect heat exchange with flash vapors in the main methane economizer and is then combined with the natural gas feed stream at a location in the liquefaction process where the natural gas feed stream and the cooled methane-rich stream are at similar conditions of temperature and pressure.

In one embodiment, the cooled methane stream is combined with the natural gas stream immediately prior to the ethylene cooling stage wherein said combined stream is liquefied in major portion (i.e., ethylene condenser), that stage preferably being the last stage of cooling in the second cycle. In another more preferred embodiment, the methane-rich stream is progressively cooled in the methane economizer with portions of the stream removed and combined with the natural gas stream or the resulting combined natural gas/methane-rich stream, as the case may be, at strategic locations upstream of the various stages of cooling in the second cycle whereat the temperatures of the streams to be combined are in close proximity to one another. A preferred embodiment of this methodology is illustrated in FIG. 1 wherein two stages of cooling are employed in the second cycle. The methane-rich stream is cooled to a first temperature in the methane economizer and a sidestream is removed which is combined with the natural gas stream upstream of the first stage of cooling in the second cycle thereby forming a first natural gas-bearing stream. The remaining portion of the methane-rich stream is further cooled in the economizer and combined with the first natural gas-bearing stream which has also undergone further cooling immediately upstream of the second stage of cooling in the second cycle thereby forming a second natural gas-bearing stream.

Inventive Embodiment

A key aspect of the current invention is the methodology and apparatus employed for cooling normally gaseous material in the first and second cycles of a cascaded refrigeration process and further, the ability to return refrigeration streams to their respective compressors at near ambient temperatures thereby avoiding or significantly reducing the exposure of key compressor components to cryogenic conditions. Such is done without the expense of additional heat exchangers, sometimes referred to as economizers, which function to raise the temperature of the respective refrigerant streams to near ambient temperatures prior to compression.

In the description which follows, reference will be made to countercurrent flow and counterflow of fluids through passages in brazed aluminum plate fin heat exchange sections. Countercurrent flow as used herein is inclusive of counterflow, cross-counterflow and combinations thereof as such terminologies are employed by the Brazed Aluminum Plate-Fin Heat Exchanger Manufacturers' Association and as set forth in *The Standards of the Brazed Aluminum Plate-Fin Heat Exchanger Manufacturers' Association*, First Edition (1994) which is hereby incorporated by reference. When discussing flow through brazed aluminum plate fin heat exchange sections or brazed aluminum plate fin heat exchangers reference will be made to a "passage". Such reference is not limited to a single passage, but rather is inclusive of the plurality of flow passages available to a given stream when flowing through said exchanger section or exchanger.

In one embodiment of the invention, a normally gaseous stream is cooled and partially condensed by a process comprising the steps of (a) flowing said normally gaseous stream and a refrigerant stream through one or more brazed aluminum plate fin heat exchange sections wherein said streams are in indirect heat exchange with and flow countercurrent to one or more refrigeration streams wherein said one or more refrigeration streams are formed by (i) removing via a splitting means a sidestream from the refrigerant stream or remaining portion thereof flowing through said one of said plate fin heat exchange sections, (ii) reducing via a pressure reduction means the pressure of the sidestream thereby generating a refrigeration stream, and (iii) flowing said refrigeration stream to said plate fin heat exchange section at a location in close proximity to said location of sidestream removal of (i) and then through the plate fin heat exchange section of (a) as a refrigeration stream, (b) separately flowing the refrigerant stream from the last heat exchange section of (a) through a brazed aluminum plate fin heat exchange section wherein said stream is in indirect heat exchange with and flows countercurrent to a vapor refrigerant stream; (c) reducing via a pressure reduction means the pressure of the refrigerant stream from the heat exchange section of step (b); (d) employing said stream of step (c) as a cooling agent on the kettle-side of a core-in-kettle heat exchanger thereby producing a vapor refrigerant stream; (e) warming the vapor refrigerant stream of (d) by flowing through at least the plate fin heat exchange section of (b); (f) compressing via a compressor the refrigeration streams of step (a) and the warmed vapor refrigerant stream of step (e); (g) cooling via a condenser the compressed stream of step (f) thereby producing the refrigerant stream of step (a); and (h) flowing the normally gaseous stream of step (a) through the core side of the core-in-kettle heat exchanger thereby producing a liquid-bearing stream. The preceding assumes necessary conduits are in place to enable the flow of identified streams between the identified elements.

In a preferred embodiment, the preceding process is additionally comprised of flowing the warmed vapor refrigerant stream of step (e) through one or more of the heat exchange sections of step (a) wherein said stream flows countercurrent to said refrigerant stream in said heat exchange section prior to the compression step of (f). The compressor is preferably designed for hydrocarbon service and more preferably for the compression of ethane, ethylene or propane. The preferred normally gaseous stream is predominantly methane and the preferred refrigerant is predominantly ethane or ethylene, more preferably consists essentially of ethane, ethylene or a mixture thereof and most preferably consists essentially of ethylene. When the heat exchange sections are individual exchangers, the heat exchange section of step (b) is preferably comprised of a core and two inlet and two outlet headers to the core where the inlet and outlet headers are situated in such a manner as to provide for countercurrent flow of the two fluid streams. Similarly, the heat exchange section or sections of step (a) is preferably comprised of a core and inlet and outlet headers to the core where the headers are attached to the core in such a manner as to provide for the countercurrent flow, more preferably counterflow, of these two fluid streams (ex., refrigerant stream and normally gaseous stream) relative to one or more refrigeration streams. In a more preferred embodiment which is particularly applicable to cooling in the first cycle, the heat exchange section of (a) is preferably comprised of a core and inlet and outlet headers to such core which provide for the countercurrent flow, more preferably counterflow, of three streams, those steams preferably being two normally gaseous streams and a refrigerant stream, relative to two streams, those streams preferably being two refrigeration streams.

In another even more preferred embodiment, the plate fin heat exchange sections employed in steps (a) and optionally (b) are contained in a single brazed aluminum plate fin heat exchanger. One such apparatus for cooling a normally gaseous stream employing the exchanger sections of steps (a) and (b) in a single brazed aluminum plate fin heat exchanger is an apparatus comprised of (a) a compressor; (b) a condenser; (c) a core-in-kettle heat exchanger; (d) at least two pressure reduction means; (e) a brazed aluminum plate fin heat exchanger comprised of (i) at least two inlet headers and at least one outlet header situated in close proximity to one another at or near one end of the plate fin heat exchanger, (ii) a least one inlet header and at least one outlet header situated in close proximity to one another at or near the end opposing that set forth in (i), (iii) at least one intermediate inlet header and at least one intermediate outlet header wherein said headers are situated along the exchanger between the headers of (i) and (ii), (iv) a core comprised of (aa) at least one flow passage connecting one of said inlet headers of (i), an outlet header of (ii) and at least one intermediate outlet header of (iii), (bb) at least one flow passage between one of the inlet headers of (ii) and either an intermediate outlet header of (iii) or an outlet header of (i), (cc) at least one flow passage between one of said intermediate inlet headers of (iii) and at least one outlet header of (i), and (dd) at least one flow passage between the inlet header of (i) and either an intermediate outlet header of (iii) or an outlet header of (ii); (f) a conduit connecting the compressor to the condenser; (g) a conduit connecting the condenser to said inlet header of (i) which is in flow communication with at least one intermediate outlet header of (iii); (h) conduits connecting each of the intermediate outlet header in flow communication with the inlet header employed in (g) to a pressure reduction means and connecting each pressure reduction means to an intermediate inlet header; (I) conduits connecting the outlet headers of (i) and the headers of (bb) to the compressor; (j) a conduit connecting the outlet header of (ii) which is in flow communication with the intermediate outlet headers to a pressure reduction means; (k) a means to insure flow communication between the pressure reduction means of (j) and the kettle-side of the core-in-kettle heat exchanger; (l) conduit connecting said kettle-side of the core-in-kettle heat exchanger to one of said inlet headers employed in (bb); (m) a conduit connected to one of said remaining inlet headers of (i); (n) conduit connecting the outlet header of (dd) or intermediate outlet header of (dd) which is in flow communication with the conduit of (m) to the core in the core-in-kettle heat exchanger; and (o) conduit connected to the exit section of the core in the core-in-kettle heat exchanger wherein said conduit extends external to the kettle.

In another preferred embodiment, the preceding apparatus is further comprised of (p) one or more additional intermediate outlet headers situated between the intermediate headers of (iii) and the outlet headers of (ii) wherein said headers are connected to the passage of (aa); (q) one or more additional intermediate inlet headers were one each of such headers are located on the plate fin heat exchanger in close proximity to an intermediate outlet header of (p); (r) a conduit, pressure reduction means, and conduit providing flow communication between each header of (p) and (q) which are in spacial proximity to one another; (s) for each intermediate inlet header of (q), an outlet header in close proximity to the headers of (i) or an intermediate outlet header situated along said plate fin heat exchanger between the header of (i) and said intermediate inlet header of (q); and (t) a core further comprised of passages connecting each such intermediate inlet header of (q) to the corresponding intermediate outlet header of (s) wherein the conduit of (I) is further comprised of such conduit necessary to connect the outlet headers of (s) to the compressor.

In the current invention, the functionality performed by the economizers in the prior art can be obtained by providing the requisite heat transfer area and associated cooling passages in the brazed aluminum plate fin heat exchange sections employed in the first and second cycles. In this manner, overall efficiencies are improved and problems associated with the exposure of key compressor components to cryogenic conditions are avoided. The current inventive embodiment still maintains a main methane economizer, but this too make take the form of a brazed aluminum plate fin heat exchanger.

Preferred Open-Cycle Embodiment of Cascaded Liquefaction Process

Figure 2:
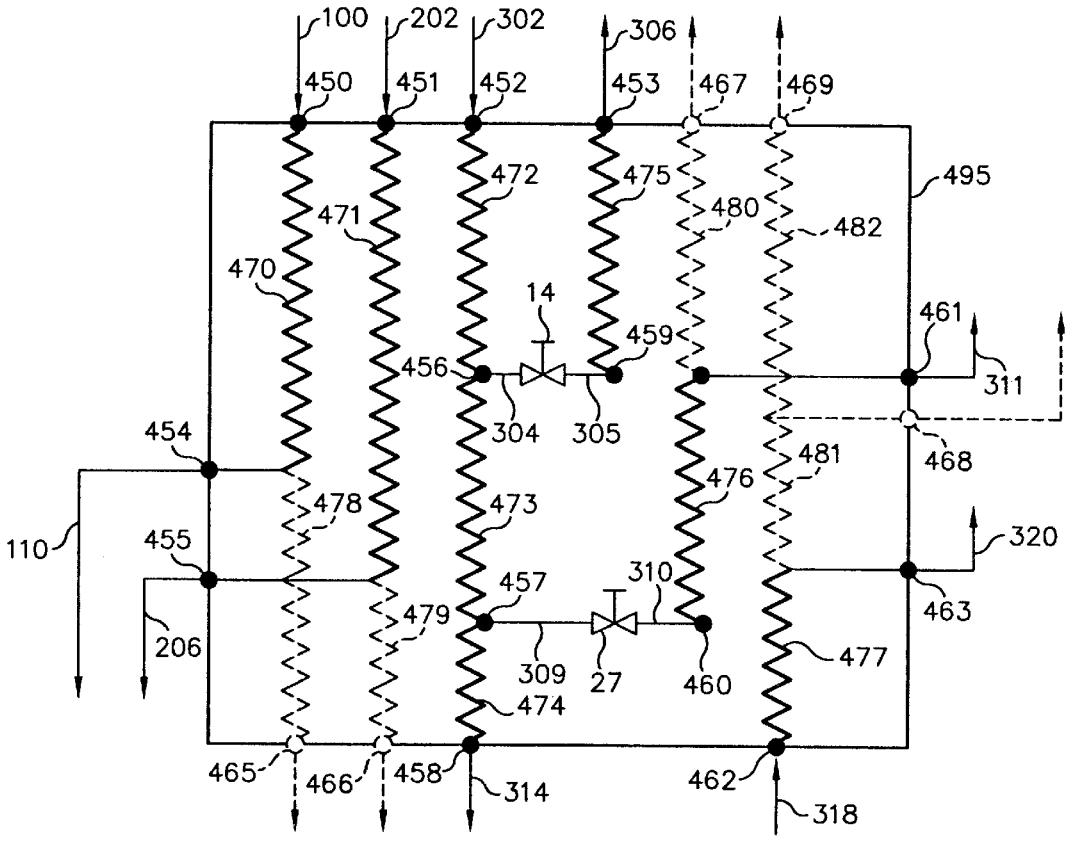
FIGS. 2 and 3 illustrate embodiments of the invention wherein certain of the brazed aluminum plate fin heat transfer sections are combined in a single heat exchanger unit.
Figure 3:
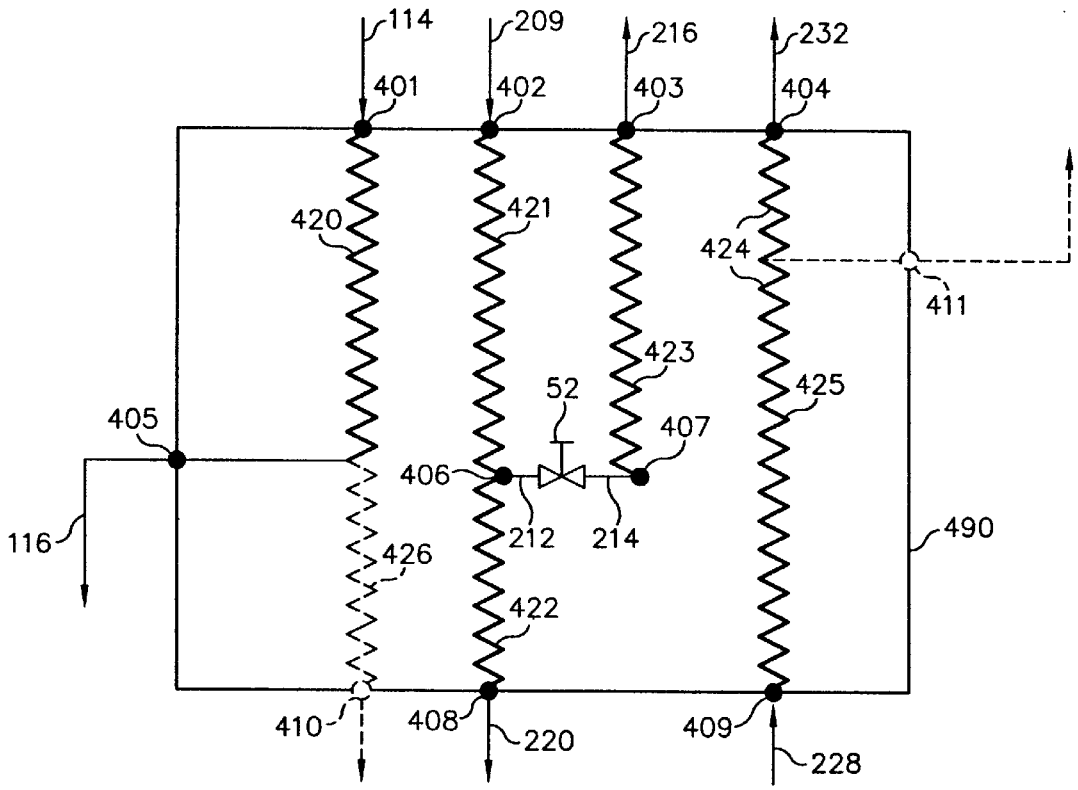

The flow schematic and apparatus set forth in FIGS. 1–3 is a preferred embodiment of the invention when employed in an open-cycle cascaded liquefaction process and is set forth for illustrative purposes. Purposely missing from the preferred embodiment is a nitrogen removal system, because such system is dependant on the nitrogen content of the feed gas. However as noted in the previous discussion of nitrogen removal technologies, methodologies applicable to this preferred embodiment are readily available to those skilled in the art. Those skilled in the art will also recognized that FIGS. 1–3 are schematics and therefore, many items of equipment that would be needed in a commercial plant for successful operation have been omitted for the sake of clarity. Such items might include, for example, compressor controls, flow and level measurements and corresponding controllers, additional temperature and pressure controls, pumps, motors, filters, additional heat exchangers, valves, etc. These items would be provided in accordance with standard engineering practice.

The first cycle in the cascaded refrigeration process is illustrative of a method and apparatus employing three stages of refrigerative cooling for cooling and liquefying a normally gaseous material. The refrigerant from the second cycle is condensed in this stage and several methane-rich streams, including the natural gas stream, are cooled in this cycle. The second cycle in the cascaded refrigeration process is illustrative of a method and apparatus employing two stages of refrigerative cooling for cooling and liquefying a normally gaseous material.

To facilitate an understanding of FIGS. 1–3, items numbered 1 thru 99 generally correspond to process vessels and equipment directly associated with the liquefaction process. Items numbered 100 thru 199 correspond to flow lines or conduits which contain methane in major portion. Items numbered 200 thru 299 correspond to flow lines or conduits which contain the refrigerant ethylene or optionally, ethane. Items numbered 300 thru 399 correspond to flow lines or conduits which contain the refrigerant propane. Items numbered 400 through 499 correspond to items associated with the brazed aluminum plate fin heat exchange sections; when one or more such sections comprise a single heat exchanger.

Referring to FIG. 1, gaseous propane is compressed in multistage compressor 18 driven by a gas turbine driver which is not illustrated. The three stages of compression preferably exist in a single unit although each stage of compression may be a separate unit and the units mechanically coupled to be driven by a single driver. Upon compression, the compressed propane is passed through conduit 300 to cooler 16 where it is liquefied. A representative pressure and temperature of the liquefied propane refrigerant prior to flashing is about 100° F. and about 190 psia. Although not illustrated in FIG. 1, it is preferable that a separation vessel be located downstream of cooler 16 and upstream of the high stage propane brazed aluminum plate fin heat exchanger 2, for the removal of residual light components from the liquefied propane and to provide surge control for the system. Such vessels may be comprised of a single-stage gas-liquid separator or may be more sophisticated and comprised of an accumulator section, a condenser section and an absorber section, the latter two of which may be continuously operated or periodically brought on-line for removing residual light components from the propane. The refrigerant stream from this vessel or the stream from cooler 16, as the case may be, is passed through conduit 302 to a high stage propane brazed aluminum plate fin heat exchange section 2 wherein said stream flows through core passages 10 wherein indirect heat exchange occurs. The cooled or second refrigerant stream is produced via conduit 303. This stream is then split via a splitting or separation means (illustrated but not numbered) into two portions, third and fourth refrigerant streams, and produced via conduits 304 and 307. The third refrigerant stream via conduit 304 flows to a pressure reduction means, illustrated as expansion valve 14, wherein the pressure of the liquefied propane is reduced thereby evaporating or flashing a portion thereof and thereby producing a high stage refrigeration stream. This stream then flows through conduit 305 and through core passages 12 wherein said stream flows countercurrent to the streams in passage 10 and yet to be described streams in passages 4, 6, and 8 and wherein indirect heat exchange occurs. This stream, the high stage recycle stream, is routed via conduit 306 to the high stage inlet port at propane compressor 18. In the course of such routing, the stream will generally pass through a suction scrubber. Also fed to plate fin heat exchange section 2 are the natural gas stream via conduit 100, a gaseous ethylene stream via conduit 202 and a methane-rich stream via conduit 152. These streams in flow passages 6, 8 and 4 and the refrigerant stream in passage 10 flow countercurrent, more preferably counterflow, to the stream in passage 12. Indirect heat exchange occurs between such streams. The streams respectively flowing in passages 4, 6, and 8 are produced via conduits 102, 204, and 154. The stream in conduit 204 will be referred to as a first cooled stream.

The cooled natural gas stream in conduit 102, the first cooled stream in conduit 204 and the fourth refrigerant stream in conduit 307 respectively flow through passages 22, 24, and 25 in brazed aluminum plate fin heat exchange section 20 countercurrent, more preferably counterflow, to a yet to be identified refrigeration stream thereby producing a further cooled natural gas stream, a second cooled stream, and a fifth refrigerant stream which are produced via conduits 110, 206 and 308. The fifth refrigerant stream is then split via a splitting or separation means (illustrated but not numbered) into two portions, the sixth and seventh refrigerant streams, and respectively produced via conduits 309 and 312. The sixth refrigerant via conduit 309 flows to a pressure reduction means, illustrated as expansion valve 27, wherein the pressure of the liquefied propane is reduced thereby evaporating or flashing a portion thereof thereby producing a intermediate-stage refrigeration stream. This stream then flows through conduit 310 and through core passage 26 wherein said stream flows countercurrent to the steams in passages 22, 24 and 25 and wherein indirect heat exchange occurs. The resulting stream is produced as an intermediate stage recycle stream via conduit 311. This stream is returned to the intermediate stage inlet port at propane compressor 18, again preferably after passing through a suction scrubber.

The further cooled natural gas stream and the second cooled stream are respectively routed via conduits 110 and 206 to respective cores 36 and 38 in core-in-kettle heat exchanger 34 wherein said natural gas stream is yet further cooled and said second cooled stream is liquefied in major portion. The streams are respectively produced via conduits 112 and 208.

The seventh refrigerant stream in conduit 312 is connected to brazed aluminum plate fin heat exchange section 28 wherein said stream flows via passage 29 countercurrent, more preferably counterflow, to and in indirect heat exchange with a low stage refrigeration fluid flowing via passage 30 thereby producing an eighth refrigerant stream via conduit 314. The eighth refrigerant via conduit 314 flows to a pressure reduction means, illustrated as expansion valve 32, wherein the pressure of the liquefied propane is reduced thereby evaporating or flashing a portion thereof thereby producing a two-phase refrigerant refrigeration stream. As previously noted, the pressure reduction step can take place via a valve with conduit (illustrated as 316) connecting the valve to the core-in-kettle heat exchanger or upon entrance to the core-in-kettle heat exchanger. The two-phase refrigeration stream is then employed as a cooling agent on the kettle-side of core-in-kettle heat exchanger 34 wherein the stream is partitioned into gas and liquid portions and said cores are at least partially submerged in the liquid portion. Removed from the kettle-side of said exchanger via conduit 318 is a low stage refrigeration stream. This conduit is connected to passage 30 in heat exchanger section 28 wherein said stream flows countercurrent and is in indirect heat exchange with the seventh refrigerant stream in passage 29 thereby producing a low stage recycle stream. The low stage recycle stream is then returned to the low-stage inlet port at compressor 18 preferably after flow through a suction scrubber via conduit 320 where said stream is compressed thereby becoming a compressed low-stage recycle stream, combined with the intermediate-stage recycle stream to form a combined intermediate-stage stream and compressed to form a compressed intermediate stage recycle stream. This stream is then combined with the high stage recycle stream to form a combined high stage recycle stream which is compressed to form a compressed refrigerant stream produced via conduit 300.

In one embodiment of the invention, the brazed aluminum plate fin heat exchange sections 2, 20, and 28 set forth above are separate heat exchangers. In another embodiment, the heat exchange sections are combined into one or more exchangers. Although resulting in a more complex heat exchanger which possesses intermediate headers, this approach offers advantages from a lay-out and cost perspective. The following embodiment wherein the heat exchanger sections are contained in a single heat exchange section is a preferred embodiment.

With regard to nomenclature, reference in the ensuing discussion will be made to first-stream, second-stream, third-stream, fourth-stream, fifth-stream and sixth-stream elements. An example to such reference is the terminology "first-stream intermediate header". In this context, reference is being made to a given element, that being an intermediate header, to which is directed at least a portion of a given flow stream, that being the first-stream. Therefore, first-stream inlet header, first-stream intermediate header and first-stream outlet header refer to headers which are connected to a common flow passage in a plate fin heat exchanger through which the first stream may flow.

In the above-cited preferred embodiment, a brazed aluminum plate fin heat exchanger is employed which is schematically depicted in FIG. 2. The depicted exchanger is comprised of (i) first-, second- and third-stream inlet headers (450, 451, 452) and a fourth-stream outlet header 453 located in close proximity to one another near one end of the plate fin heat exchanger 495; (ii) a third-streatm outlet header 458 and sixth-stream inlet header 462 located in close proximity to one another near the end opposing that set forth in (i); (iii) third-, fourth- and fifth-stream intermediate headers of (iii) (456, 459, 461) spatially located along the exchanger between the headers of (i) and (ii) and in spacial proximity to one another; (iv) first-, second-, third-, fifth- and sixth-stream intermediate headers of (iv) (454, 455, 457, 460, 463) spatially located along the exchanger between the headers of (iii) and the headers of (ii); and (v) a core within the plate fin heat exchanger comprised of at least one heat exchange conduit (i.e. passage) 470 connecting the first-stream inlet header 450 and the first-stream intermediate header of (iv) 454, at least one heat exchange conduit 471 connecting the second-stream inlet header 451 and to the second-stream intermediate header of (iv) 455, at least one heat exchange conduit connecting the third-stream inlet header 452, the third-stream intermediate header of (iii) 456, the third-stream intermediate header of (iv) 457 and the third-stream outlet header 458 (such conduits illustrated in FIG. 2 as 472, 473 and 474), at least one heat exchange conduit 475 connecting the fourth-stream intermediate header 459 to the fourth-stream outlet header 453, at least one heat exchange conduit 476 connecting the fifth-stream intermediate header of (iv) 460 to the fifth-stream intermediate header of (iii) 461, and at least one heat exchange conduit 477 connecting the sixth-stream inlet header 462 to the sixth stream intermediate header of (iv) 463. This embodiment is additionally comprised of two pressure reduction means 14 and 27. Pressure reduction means 14 is respectively connected via conduit 304 to the third-stream intermediate header of (iii) 456 and via conduit 305 to the fourth stream intermediate header of (iii) 459. Pressure reduction means 27 is respectively connected via conduit 309 to the third-stream intermediate header of (iv) 457 and via conduit 310 to the fifth intermediate header of (iv) 460. In this embodiment, conduit 100 is connected to the first-stream inlet header 450, conduit 202 is connected to the second-stream inlet header 451, conduit 302 is connected to the third-stream inlet header 452, conduit 306 is connected to the fourth-stream outlet header 453, conduit 110 is connected to the first-stream intermediate header 454, conduit 206 is connected to the second-stream intermediate header 455, conduit 314 is connected to the third-stream outlet header 458, conduit 318 is connected to the sixth-stream inlet header 462, conduit 320 is connected to the sixth-stream intermediate header 463, and conduit 311 is connected to the fifth stream intermediate header 461. In another similar embodiment, the headers and internal passages associated with the fifth stream intermediate header at (iii) and the sixth-stream intermediate header of (iv) can be moved such that the outlets are closer or in close proximity to the headers (i), respectfully illustrated in FIG. 2 as heat transfer conduits 480, 481 and 482 and header locations 467, 468 and 469. In a similar manner, the first-stream and second-stream intermediate headers of (iv) and associated passages can be moved so as to be in closer proximity to the headers of (ii), respectfully illustrated as heat transfer conduits 478 and 479 and header locations 465 and 466. These latter embodiments are illustrated in FIG. 2 via dashed format.

In the second cooling cycle in the preferred embodiment depicted in FIG. 1, the natural gas stream, that being a normally gaseous material, is condensed. The refrigerant stream employed in this cycle is preferably ethylene. As noted in FIG. 1, a low stage recycle stream delivered via conduit 232 is compressed and the resulting compressed low-stage recycle stream is preferably removed from compressor 40 via conduit 234, cooled via inter-stage cooler 71, returned to the compressor via conduit 236 and combined with a high-stage recycle stream delivered via conduit 216 whereupon the combined stream is compressed thereby producing a compressed refrigerant stream via conduit 200. A preferred pressure for the compressed refrigerant stream is approximately 300 psia. Preferably, the two compressor stages are a single module although they may each be a separate module and the modules mechanically coupled to a common driver. The compressed ethylene, also referred to in this cycle as compressed refrigerant stream is routed from the compressor to the downstream cooler 72 via conduit 200. The product from the cooler flows via conduit 202 and is introduced, as previously discussed, to the first cycle wherein said stream is further cooled, liquefied and returned via conduit 208. This stream preferably flows to a separation vessel 41 which provides for the removal of residual light components from the liquefied stream and which also provides surge volume for the refrigeration system. Such vessels may be comprised of a single-stage gas-liquid separator or may be more sophisticated and comprised of an accumulator section, a condenser section and an absorber section, the latter two of which may be continuously operated or periodically brought on-line for removing residual light components from the refrigerant. A refrigerant stream, referred to herein with regard to the second cycle as a first refrigerant stream, is produced from vessel 41 via conduit 209.

The cooled natural gas stream (a normally gaseous material) produced via conduit 112 is combined with a yet to be described methane-rich stream provided via conduit 156. This combined stream via conduit 114 and the first refrigerant stream via conduit 209 are routed to the first brazed aluminum plate fin heat exchange section 42 in this cycle wherein these streams flow through core passages 44 and 46 countercurrent, more preferably counterflow, to and in indirect heat exchange with a yet to be described high-stage refrigeration stream and optionally, a low-stage refrigeration stream respectively flowing in passages 48 and 50. A cooled stream referred to herein as second refrigerant stream is produced from passage 46 via conduit 210. This stream is then split via a splitting or separation means (illustrated but not numbered) into two portions, third and fourth refrigerant streams, and produced via conduits 212 and 218. The third refrigerant stream via conduit 212 flows to a pressure reduction means, illustrated as expansion valve 52, wherein the pressure of the liquefied ethylene is reduced thereby evaporating or flashing a portion thereof thereby producing a high stage refrigeration stream. This stream then flows through conduit 214 and through core passage 48 thereby producing a high stage recycle stream which is transported via conduit 216 to the high stage inlet port of compressor 40.

Produced from passage 44 via conduit 116 is a further cooled natural gas stream which is optionally combined with a methane-rich recycle stream delivered via conduit 158. The resulting stream routed via conduit 120 to core 59 in core-in-kettle heat exchanger 58 wherein the stream is liquefied in major portion and the resulting stream produced via conduit 122.

The fourth refrigerant stream is transported via conduit 218 to passage 54 in second brazed aluminum plate fin heat exchange section 53. The fourth refrigerant stream flows countercurrent, more preferably counterflow, to and is in indirect heat exchange with a low stage refrigeration fluid flowing via passage 55 in heat exchange section 53 thereby producing a fifth refrigerant stream via conduit 220. The fifth refrigerant stream via conduit 220 flows through a pressure reduction means, illustrated as expansion valve 56, wherein the pressure of the liquefied ethylene is reduced thereby evaporating or flashing a portion thereof thereby producing a two-phase refrigerant stream. As previously noted, the pressure reduction step can take place via a valve with conduit (illustrated as 226) connecting the valve to the core-in-kettle heat exchanger or upon entrance to the core-in-kettle heat exchanger. The resulting two-phase refrigerant stream is then employed as a cooling agent on the kettle-side of core-in-kettle heat exchanger 58 wherein the stream is partitioned into gas and liquid portions and said cores are at least partially submerged in the liquid portion. Removed from the kettle-side of said exchange via conduit 228 is a low stage refrigeration stream. This conduit is connected to passage 55 in heat exchanger section 53 wherein said stream flows countercurrent and is in indirect heat exchange with the fluid in passage 54 thereby producing a low stage recycle stream. This stream is returned to the low stage inlet port at compressor 40 via conduit 232. Optionally, and as depicted in FIG. 1 this stream may also flow to the first plate fin heat exchanger in the cycle, 42, via conduit 230 and through passage 50 wherein said stream flows countercurrent, more preferably counterflow, to the fluids in passages 44 and 46 and is further warmed prior to flow to the compressor via conduit 232. Because of concern with the exposure of certain compressor components to cryrogenic conditions, this latter approach is preferred.

In one embodiment of the invention, brazed aluminum plate fin heat exchange sections 42 and 53 which are situated in the second cycle are separate heat exchangers. In another embodiment, the heat exchange sections are combined into a single exchanger. Although resulting in a more complex heat exchanger which possesses intermediate headers, this approach offers advantages from a lay-out and cost perspective. The following embodiment wherein the heat exchanger sections are combined into a single heat exchange section is a preferred embodiment. With regard to nomenclature in the ensuing discussion, reference will be made to first-stream, second-stream, third-stream, and fourth-stream elements, for example a first-stream intermediate header. In this context, reference is being made to a given element, that being an intermediate header to which is directed at least a portion of a given flow stream, that being the first-stream. Therefore, a second-stream inlet header, second-stream intermediate header and second-stream outlet header refer to headers which are connected to a common flow passage in a plate fin heat exchanger through which the second stream may flow.

A preferred embodiment which is illustrated in FIG. 3, a brazed aluminum plate fin heat exchanger 490 is employed which is comprised of (i) first-stream and second-stream inlet headers, 401 and 402, and third-stream and fourth-stream outlet headers, 403 and 404, located in close proximity to one another near one end of the plate fin heat exchanger; (ii) a second-stream outlet header 408 and a fourth-stream inlet header 409 located in close proximity to one another at the end opposing that set forth in (i); (iii) first-stream intermediate header 405, a second-stream intermediate header 406, and third-stream intermediate header 407 where said headers are situated between the headers of (i) and (ii) on said plant fin heat exchanger; (iv) a core within the plate fin heat exchanger comprised of at least one heat exchange conduit or passage 420 connecting the first-stream inlet header 401 and the first-stream intermediate header 405, at least one heat exchange conduit 421 connected the second-stream inlet header 402 to the second-stream intermediate header 406 and at least one heat exchange conduit 422 connecting the second-stream intermediate header 406 to the second-stream outlet header 408, at least one heat exchange conduit 423 connecting the third-stream intermediate header 407 to the third-stream outlet header 403, and at least one heat exchange conduit 424 connecting the fourth-stream inlet header 409 to the fourth-stream outlet header 404. Pressure reduction means 52 is respectively connected via conduit 212 to the second stream intermediate header 406 and via conduit 214 to the third-stream intermediate header 407. In this embodiment, conduit 114 is connected to the first-stream inlet header 401, conduit 116 is connected to the first-stream intermediate header 405, conduit 209 is connected to the second-stream inlet header 402, conduit 220 is connected to the second-stream outlet header 408, conduit 216 is connected to the third-stream outlet header 403, conduit 228 is connected to the fourth-stream inlet header 409 and conduit 232 is connected to the fourth-stream outlet header 404. In an optional configuration, the first-stream intermediate header 405 and associated flow passages are arranged so as to position said header in closer proximity to the headers of (ii). This is illustrated in FIG. 3 in dashed format via the addition of flow passage 426 to flow passage 420 and the substitution of first stream outlet header 410 for first stream intermediate header 405. In another embodiment, heat exchange conduit 424 is shorted, illustrated as conduit 425, and fourth-stream outlet header 404 is replaced by a fourth-stream intermediate header 411. These configurations are illustrated in FIG. 3 via dashed format.

The gas in conduit 154, that being a compressed recycled methane refrigerant stream, is fed to main methane economizer 74 which will be described in greater detail wherein the stream is cooled via indirect heat exchange means. In one embodiment and as illustrated in FIG. 1, the stream is delivered via conduit 154 is cooled in the main methane economizer 74 via indirect heat exchange means 97, a portion removed via conduit 156 and the remaining stream further cooled via indirect heat exchange means 98 and produced via conduit 158. This is a preferred embodiment. In this split stream embodiment, a portion of the compressed methane recycle stream delivered via conduit 156 is combined with the natural gas stream via conduit 112 immediately upstream of the second cycle and the remaining portion delivered via conduit 158 combined with the stream in conduit 116 immediately upstream of the core-in-kettle heat exchanger 58 wherein the majority of liquefaction of the natural gas stream occurs. In a simpler embodiment (i.e., less preferred from a process efficiency perspective), the methane recycle stream is cooled in its entirety in the main methane economizer 74 and combined via conduit 158 with the natural gas stream in conduit 112 immediately upstream of the second cycle.

The liquefied stream produced from the core-in-kettle heat exchanger via conduit 122 is generally at a temperature of about −125° F. and a pressure of about 600 psi. This stream passes via conduit 122 to the main methane economizer 74, wherein the stream is further cooled by indirect heat exchange means 76 as hereinafter explained. From the main methane economizer 74 the liquefied gas passes through conduit 124 and its pressure is reduced by a pressure reduction means which is illustrated as expansion valve 78, which of course evaporates or flashes a portion of the gas stream. The flashed stream is then passed to methane high-stage flash drum 80 where it is separated into a gas phase discharged through conduit 126 and a liquid phase discharged through conduit 130. The gas-phase is then transferred to the main methane economizer via conduit 126 wherein the vapor functions as a coolant via indirect heat transfer means 82. The vapor exits the main methane economizer via conduit 128 which is connected to the high-stage pressure inlet port on the compressor 83 from which is produced a compressed methane stream which is routed via conduit 150 to a cooler 86 where said stream is cooled and produced via conduit 152.

The liquid phase produced via conduit 130 is passed through a second methane economizer 87 wherein the liquid is further cooled by downstream flash vapors via indirect heat exchange means 88, preferably arranged to provide for countercurrent flow of the liquid stream relative to the downstream vapor streams. The cooled liquid exits the second methane economizer 87 via conduit 132 and is expanded or flashed via pressure reduction means illustrated as expansion valve 91 to further reduce the pressure and at the same time, vaporize a second portion thereof. This flash stream is then passed to intermediate-stage methane flash drum 92 where the stream is separated into a gas phase passing through conduit 136 and a liquid phase passing through conduit 134. The gas phase flows through conduit 136 to the second methane economizer 87 wherein the vapor cools the liquid introduced to 87 via conduit 130 via indirect heat exchanger means 89. Conduit 138 serves as a flow conduit between indirect heat exchange means 89 in the second methane economizer 87 and the indirect heat transfer means 95 in the main methane economizer 74. This vapor leaves the main methane economizer 74 via conduit 140 which is connected to the intermediate stage inlet on the methane compressor 83.

The liquid phase exiting the intermediate stage flash drum 92 via conduit 134 is further reduced in pressure by passage through a pressure reduction means illustrated as a expansion valve 93. Again, a third portion of the liquefied gas is evaporated or flashed. The fluids from the expansion valve 93 are passed to final or low stage flash drum 94. In flash drum 94, a vapor phase is separated and passed through conduit 144 to the second methane economizer 87 wherein the vapor functions as a coolant via indirect heat exchange means 90, exits the second methane economizer via conduit 146 which is connected to the first methane economizer 74 wherein the vapor functions as a coolant via indirect heat exchange means 96 and ultimately leaves the first methane economizer via conduit 148 which is connected to the low-stage inlet port on compressor 83. Preferably and as illustrated in FIG. 1, the vapor streams in indirect heat exchange means 82, 95 and 96 in the main methane economizer 74 flow countercurrent to the liquid stream in indirect heat exchange means 76 and the vapor streams in indirect heat exchange means 97 and 98.

The liquefied natural gas product from flash drum 94 which is at approximately atmospheric pressure is passed through conduit 142 to the storage unit. The low pressure, low temperature LNG boil-off vapor stream from the storage unit and optionally, the vapor returned from the cooling of the rundown lines associated with the LNG loading system, is preferably recovered by combining such stream or streams with the low pressure flash vapors present in either conduits 144, 146, or 148; the selected conduit being based on an attempt to match the temperature of the vapor stream as closely as possible.

As shown in FIG. 1, the three stages of compression provided by compressor 83 are preferably contained in a single unit. However, each compression stage may exist as a separate unit where the units are mechanically coupled together to be driven by a single driver. The compressed gas from the low-stage section preferably passes through an inter-stage cooler 85 and is combined with the intermediate pressure gas in conduit 140 prior to the second-stage of compression. The compressed gas from the intermediate stage of compressor 83 is preferably passed through an inter-stage cooler 84 and is combined with the high pressure gas in conduit 140 prior to the third-stage of compression. The compressed gas is discharged from the high-stage methane compressor through conduit 150, is cooled in cooler 86 and is routed to the high pressure propane chiller via conduit 152 as previously discussed.

FIG. 1 depicts the expansion of the liquefied phase using expansion valves with subsequent separation of gas and liquid portions in the chiller or condenser. While this simplified scheme is workable and utilized in some cases, it is often more efficient and effective to carry out partial evaporation and separation steps in separate equipment, for example, an expansion valve and separate flash drum might be employed prior to the flow of either the separated vapor or liquid to a chiller. In a like manner, certain process streams undergoing expansion are ideal candidates for employment of a hydraulic or gas expander as the case may be, as part of the pressure reduction means thereby enabling the extraction of work energy and also lower two-phase temperatures.

With regard to the compressor/driver units employed in the process, FIG. 1 depicts individual compressor/driver units (i.e., a single compression train) for the propane, ethylene and open-cycle methane compression stages. However in a preferred embodiment for any cascaded process, process reliability can be improved significantly by employing a multiple compression train comprising two or more compressor/driver combinations in parallel in lieu of the depicted single compressor/driver units. In the event that a compressor/driver unit becomes unavailable, the process can still be operated at a reduced capacity.

While specific cryogenic methods, materials, items of equipment and control instruments are referred to herein, it is to be understood that such specific recitals are not to be considered limiting but are included by way of illustration and to set forth the best mode in accordance with the present invention.

That which is claimed is:

1. A process for cooling a normally gaseous stream comprising the steps of:

(a) flowing said normally gaseous stream and a refrigerant stream through one or more brazed aluminum plate fin heat exchange sections wherein said streams are in indirect heat exchange with and flow countercurrent to one or more refrigeration streams wherein said one or more refrigeration streams are formed by (i) removing a sidestream from the refrigerant stream or portion thereof produced from one of said plate fin heat exchange sections;

(ii) reducing the pressure of the sidestream thereby generating a refrigeration stream; and (iii) flowing said refrigeration stream to the heat exchange section from which said refrigerant stream of (i) was produced whereupon said refrigeration stream becomes one of said refrigeration stream of (a);

(b) separately flowing the refrigerant stream from the last heat exchange section of (a) through a brazed aluminum plate fin heat exchange section wherein said stream is in indirect heat exchange with and flows countercurrent to a vapor refrigerant stream;

(c) reducing the pressure of the refrigerant stream from the heat exchange section of step (b);

(d) employing said stream of step (c) as a cooling agent on the kettle-side of a core-in-kettle heat exchanger thereby producing a vapor refrigerant stream;

(e) warming the vapor refrigerant stream of (d) by flowing through at least the plate fin heat exchange section of (b);

(f) compressing the refrigeration streams of step (a) and the warmed vapor refrigerant stream of step (e);

(g) cooling the compressed stream of step (f) thereby producing the refrigerant stream of step (a); and (h) flowing the normally gaseous stream from step (a) through the core side of the core-in-kettle heat exchanger thereby producing a liquid-bearing stream.

2. A process according to claim 1 further comprising the additional step of:

(I) flowing the warmed vapor refrigeration stream of step (e) through one or more of the heat exchange sections of step (a) wherein said stream flows in countercurrent to said refrigerant stream in said heat exchange section prior to the compression step of (f).

3. A process according to claim 1 wherein said normally gaseous stream is predominantly methane and said refrigerant stream is predominantly ethylene or ethane.

4. A process according to claim 1 wherein said liquid-bearing stream from the core-in-kettle heat exchanger is comprised in major portion of liquid.

5. A process for cooling a normally gaseous stream comprising the steps of:

(a) flowing said normally gaseous stream and a first refrigerant stream through a first brazed aluminum plate fin heat exchange section wherein said streams are in indirect heat exchange and flow countercurrent to a high-stage refrigeration stream thereby producing a first cooled stream and a second refrigerant stream;

(b) flowing said first cooled stream through the core of a core-in-kettle heat exchanger thereby producing a liquid-bearing stream;

(c) separating said second refrigerant stream into a third refrigerant stream and fourth refrigerant stream;

(d) reducing the pressure of said third refrigerant stream thereby producing said high-stage refrigeration stream;

(e) flowing said high-stage refrigeration stream through said first heat exchange section thereby producing a high-stage recycle stream;

(f) flowing said fourth refrigerant stream through a second brazed aluminum plate fin heat exchange section wherein said stream is in indirect heat exchange and flows countercurrent to a low-stage refrigeration stream thereby producing a fifth refrigerant stream;

(g) reducing the pressure of said fifth refrigerant stream thereby producing a two-phase refrigerant stream;

(h) employing said stream of step (g) as a cooling agent on the kettle-side of a core-in-kettle heat exchanger wherein is contained gas and liquid portions and said core is at least partially submerged in the liquid portion;

(i) removing from the gas portion on the kettle-side of said core-in-kettle heat exchanger said low-stage refrigeration stream;

(j) flowing said low-stage refrigeration stream through said second heat exchange section thereby producing a low-stage recycle stream;

(k) compressing said low-stage recycle thereby producing a compressed low-stage recycle stream;

(l) combining said compressed low-stage recycle stream and the high-stage recycle stream thereby producing a combined high-stage stream;

(m) compressing said combined high-stage stream to an elevated pressure thereby producing a compressed refrigerant stream; and (n) cooling said compressed refrigerant stream thereby producing the first refrigerant stream of step (a).

6. A process according to claim 5 wherein said normally gaseous stream is predominantly ethylene or ethane and said first refrigerant stream is predominantly propane.

7. A process according to claim 5 wherein said normally gaseous stream is predominantly methane and said first refrigerant stream is predominantly ethylene or ethane.

8. A process according to claim 7 further comprising the step of combining said first cooled stream with a pre-cooled methane-rich gas stream prior to flowing to the core in the core-in-kettle heat exchanger.

9. A process according to claim 5 wherein said liquid-bearing stream from the core-in-kettle heat exchanger is comprised in major portion of liquid.

10. A process according to claim 5 additionally comprising the step of:

(o) flowing the low-stage recycle stream through said first heat exchange section in indirect heat exchange with and countercurrent to both the first refrigerant stream and the normally gaseous stream prior to the compression step of (k).

11. A process according to claim 5 wherein said first brazed aluminum plate fin heat exchange section and said second brazed aluminum plate fin heat exchange section are contained in a single brazed aluminum plate fin heat exchanger.

12. A process according to claim 6 wherein said first brazed aluminum plate fin heat exchange section and said second brazed aluminum plate fin heat exchange section are contained in a single brazed aluminum plate fin heat exchanger.

13. A process according to claim 7 wherein said first brazed aluminum plate fin heat exchange section and said second brazed aluminum plate fin heat exchange section are contained in a single brazed aluminum plate fin heat exchanger.

14. A process according to claim 10 wherein said first brazed aluminum plate fin heat exchange section and said second brazed aluminum plate fin heat exchange section are contained in a single brazed aluminum plate fin heat exchanger.

15. A process for cooling a normally gaseous stream comprising the steps of:

(a) flowing said normally gaseous stream and a first refrigerant stream through a first brazed aluminum plate fin heat exchange section wherein said streams are in indirect heat exchange with and flow countercurrent to a high-stage refrigeration stream thereby producing a first cooled stream and a second refrigerant stream;

(b) separating said second refrigerant stream into a third refrigerant stream and fourth refrigerant stream;

(c) reducing the pressure of said third refrigerant stream thereby producing said high-stage refrigeration stream;

(d) flowing said high-stage refrigeration stream through said first heat exchange section thereby producing a high-stage recycle stream;

(e) flowing said first cooled stream and said fourth refrigerant stream through a second brazed aluminum plate fin heat exchange section wherein said streams are in indirect heat exchange with and flow countercurrent to an intermediate-stage refrigeration stream thereby producing a second cooled stream and a fifth refrigerant stream;

(f) separating said fifth refrigerant stream into a sixth refrigerant stream and seventh refrigerant stream;

(g) reducing the pressure of said sixth refrigerant stream thereby producing an intermediate-stage refrigeration stream;

(h) flowing said intermediate-stage refrigeration stream through said second heat exchange section thereby producing an intermediate-stage recycle stream;

(i) flowing said seventh refrigerant stream through a third brazed aluminum plate fin heat exchange section wherein the stream is in indirect heat exchange with and flows countercurrent to a low-stage refrigeration stream thereby producing an eighth refrigerant stream;

(j) flowing said second cooled stream through the core of a core-in-kettle heat exchanger thereby producing a further cooled stream;

(k) reducing the pressure of said seventh refrigerant stream thereby producing a two-phase refrigerant stream;

(l) employing said stream of step (k) as a cooling agent on the kettle-side of a core-in-kettle heat exchanger wherein is contained gas and liquid portions and said core is at least partially submerged in the liquid portion;

(m) removing from gas portion on the kettle-side of said core-in-kettle heat exchanger said low-stage refrigeration stream;

(n) flowing said low-stage refrigeration stream through said third plate fin heat exchange section thereby producing a low-stage recycle stream;

(o) compressing said low-stage recycle thereby producing a compressed low-stage recycle stream;

(p) combining said compressed low-stage recycle stream and the intermediate-stage recycle stream thereby producing a combined intermediate-stage stream;

(q) compressing said combined intermediate-stage stream to an elevated pressure thereby producing a compressed intermediate-stage recycle stream;

(r) combining said compressed intermediate-stage recycle stream and the high-stage recycle stream thereby producing a combined high-stage recycle stream;

(s) compressing said combined high-stage recycle stream to an elevated pressure thereby producing a compressed refrigerant stream; and (t) cooling said compressed refrigerant stream thereby producing the first refrigerant stream of step (a).

16. A process according to claim 15 wherein said normally gaseous stream is predominantly ethylene or ethane and said first refrigerant stream is predominantly propane.

17. A process according to claim 16 additionally comprising the steps of:

(u) flowing a predominantly methane stream through said first heat exchange section in indirect heat exchange with and countercurrent to said high stage refrigeration stream thereby producing a first cooled methane stream;

(v) flowing the first cooled methane stream through said second heat exchange section in indirect heat exchange with and in countercurrent to the intermediate stage refrigeration stream thereby producing a second cooled methane stream; and (w) flowing the second cooled methane stream through a second core wherein said second core is situated in the kettle in the core-in-kettle heat exchanger of step (l) thereby producing a third cooled methane stream.

18. A process according to claim 15 additionally comprising the step of:

(u) flowing the low-stage recycle stream through said second exchange section in indirect heat exchange with and countercurrent to said first cooled stream and fourth refrigerant stream prior to the compression step.

19. A process according to claim 16 additionally comprising the additional step of:

(u) flowing the intermediate-stage recycle stream through said first heat exchange section in indirect heat exchange with and countercurrent to said normally gaseous stream and first refrigerant stream prior to the compression step.

20. A process according to claim 18 additionally comprising the additional step of:

(v) flowing the intermediate-stage recycle stream through said first heat exchange section in indirect heat exchange with and countercurrent to said normally gaseous stream and first refrigerant stream prior to the compression step.

21. A process according to claim 15 wherein said normally gaseous stream is predominantly methane and said first refrigerant stream is predominantly ethylene or ethane.

22. A process according to claim 21 further comprising the step of combining the second cooled stream and a pre-cooled methane-rich gas stream prior to flowing said combined stream through said core in the core-in-kettle heat exchanger.

23. A process according to claim 15 wherein said further cooled stream from the core-in-kettle heat exchanger is comprised in major portion of liquid.

24. A process according to claim 15 wherein two or more of the heat exchange sections selected from the group consisting of the first plate fin heat exchange section, the second plate fin heat exchange section, and the third plate fin heat exchange section are contained in a single brazed aluminum plate fin heat exchanger.

25. A process according to claim 16 wherein two or more of the heat exchanger sections selected from the group consisting of the first plate fin heat exchange section, the second plate fin heat exchange section, and the third plate fin heat exchange section are contained in a single brazed aluminum plate fin heat exchanger.

26. A process according to claim 17 wherein two or more of the heat exchanger sections selected from the group consisting of the first plate fin heat exchange section, the second plate fin heat exchange section, and the third plate fin heat exchange section are contained in a single brazed aluminum plate fin heat exchanger.

27. A process according to claim 20 wherein two or more of the heat exchanger sections selected from the group consisting of the first plate fin heat exchange section, the second plate fin heat exchange section, and the third plate fin heat exchange section are contained in a single brazed aluminum plate fin heat exchanger.

28. A process according to claim 21 wherein two or more of the heat exchanger sections selected from the group consisting of the first plate fin heat exchange section, the second plate fin heat exchange section, and the third plate fin heat exchange section are contained in a single brazed aluminum plate fin heat exchanger.

29. A process for cooling a normally gaseous stream comprising the steps of:

(a) flowing said normally gaseous stream and a first-cycle refrigerant stream through a first brazed aluminum plate fin heat exchange section wherein said streams are in indirect heat exchange with and flow countercurrent to a high-stage first-cycle refrigeration stream thereby producing a cooled stream and a second first-cycle refrigerant stream;

(b) separating said second first-cycle refrigerant stream into a third first-cycle refrigerant stream and fourth first-cycle refrigerant stream;

(c) reducing the pressure of said third first-cycle refrigerant stream thereby producing said high-stage first-cycle refrigeration stream;

(d) flowing said high-stage first-cycle refrigeration stream through said first heat exchange section thereby producing a high-stage first-cycle recycle stream;

(e) flowing said cooled stream and said fourth first-cycle refrigerant stream through a second brazed aluminum plate fin heat exchange section wherein said streams are in indirect heat exchange with and flow countercurrent to an intermediate-stage first-cycle refrigeration stream thereby producing a second cooled stream and a fifth first-cycle refrigerant stream;

(f) separating said fifth first-cycle refrigerant stream into a sixth first-cycle refrigerant stream and seventh first-cycle refrigerant stream;

(g) reducing the pressure of said sixth first-cycle refrigerant stream thereby producing an intermediate-stage first-cycle refrigeration stream;

(h) flowing said intermediate-stage first-cycle refrigeration stream through said second heat exchange section thereby producing an intermediate-stage first-cycle recycle stream;

(i) flowing said seventh first-cycle refrigerant stream through a third brazed aluminum plate fin heat exchange section wherein the stream is in indirect heat exchange with and flows countercurrent to a low-stage first-cycle refrigeration stream thereby producing an eighth first-cycle refrigerant stream;

(j) flowing said second cooled stream through the core of a core-in-kettle heat exchanger thereby producing third cooled stream;

(k) reducing the pressure of said eighth first-cycle refrigerant stream thereby producing a two-phase first-cycle refrigerant stream;

(l) employing said stream of step (k) as a cooling agent on the kettle-side of a core-in-kettle heat exchanger wherein is contained gas and liquid portions and said core is at least partially submerged in the liquid portion;

(m) removing from gas portion on the kettle-side of said core-in-kettle heat exchanger a low-stage first-cycle refrigeration stream;

(n) flowing said low-stage first-cycle refrigeration stream through said third plate fin heat exchange section thereby producing a low-stage first-cycle recycle stream;

(o) compressing said low-stage first-cycle recycle thereby producing a compressed low-stage first-cycle recycle stream;

(p) combining said compressed low-stage first-cycle recycle stream and the intermediate-stage first-cycle recycle stream thereby producing a combined intermediate-stage first-cycle stream;

(q) compressing said combined intermediate-stage first-cycle stream to an elevated pressure thereby producing a compressed intermediate-stage first-cycle recycle stream;

(r) combining said compressed intermediate-stage first-cycle recycle stream and the high-stage first-cycle recycle stream thereby producing a combined high-stage first-cycle recycle stream;

(s) compressing said combined high-stage first-cycle recycle stream to an elevated pressure thereby producing a compressed first-cycle refrigerant stream;

(t) cooling said compressed first-cycle refrigerant stream thereby producing the first first-cycle refrigerant stream of step (a);

(u) flowing said third cooled stream and a second-cycle refrigerant stream through a fourth brazed aluminum plate fin heat exchange section wherein said streams are in indirect heat exchange with and flow countercurrent to a high-stage second-cycle refrigeration stream and thereby producing a fourth cooled stream and a second second-cycle refrigerant stream;

(v) separating said second second-cycle refrigerant stream into a third second-cycle refrigerant stream and fourth second-cycle refrigerant stream;

(w) reducing the pressure of said third second-cycle refrigerant stream thereby producing said high-stage second-cycle refrigeration stream;

(x) flowing said high-stage second-cycle refrigeration stream through said fourth heat exchange section thereby producing a high-stage second-cycle recycle stream;

(y) flowing said fourth second-cycle refrigerant stream through a fifth brazed aluminum plate fin heat exchange section wherein said stream is in indirect heat exchange with and flows countercurrent to a low-stage second-cycle refrigeration stream thereby producing a fifth second-cycle refrigerant stream;

(z) reducing the pressure of said fifth second-cycle refrigerant stream thereby producing a two-phase second-cycle refrigerant stream;

(aa) employing said stream of step (z) as a cooling agent on the kettle-side of a core-in-kettle heat exchanger wherein is contained gas and liquid portions and said core is at least partially submerged in the liquid portion;

(bb) removing from the gas portion on the kettle-side of said core-in-kettle heat exchanger a low-stage second-cycle refrigeration stream;

(cc) flowing said fourth cooled stream through the core of a core-in-kettle heat exchanger thereby producing a liquid-bearing stream;

(dd) flowing said low-stage second-cycle refrigeration stream through said fourth heat exchange section thereby producing a low-stage second-cycle recycle stream;

(ee) compressing said low-stage second-cycle recycle stream thereby producing a compressed low-stage second-cycle recycle stream;

(ff) combining said compressed low-stage second-cycle recycle stream and the high-stage second-cycle recycle stream thereby producing a combined high-stage second-cycle recycle stream;

(gg) compressing said combined high-stage second-cycle recycle stream to an elevated pressure thereby producing a compressed second-cycle refrigerant stream; and (hh) cooling said compressed second-cycle refrigerant stream thereby producing the second second-cycle refrigerant stream of step (u).

30. A process according to claim 29 wherein said normally gaseous stream is predominantly methane, said first-cycle refrigerant stream is predominantly propane, and said second-cycle refrigerant stream is predominantly ethylene or ethane.

31. A process according to claim 29 further comprising the step of combining the fourth cooled stream and a pre-cooled methane-rich gas stream prior to flowing said combined stream through the core in the core-in-kettle heat exchanger.

32. A process according to claim 29 wherein two or more of the heat exchanger sections selected from the group consisting of the first plate fin heat exchange section, the second plate fin heat exchange section, and the third plate fin heat exchange section are contained in a single brazed aluminum plate fin heat exchanger.

33. A process according to claim 32 wherein the fourth plate fin heat exchange section and the fifth plate fin heat exchange section are contained in a single brazed aluminum plate fin heat exchanger.

34. A process according to claim 29 wherein the fourth plate fin heat exchange section and the fifth plate fin heat exchange section are contained in a single brazed aluminum plate fin heat exchanger.

35. A process according to claim 29 wherein at least a portion of the cooling for step (hh) is provided by flowing said compressed stream through one or more heat exchange sections selected from the group consisting of the first heat exchange section, the second heat exchange section and the third heat-exchange section and wherein said stream is in indirect contact with and flows countercurrent one or more of said refrigeration streams.

36. A process according to claim 35 wherein a portion of the cooling for step (hh) is provided by flowing said compressed stream through a second core wherein said core is situated in the core-in-kettle heat exchanger of step (j).

37. A process according to claim 33 wherein at least a portion of the cooling for step (hh) is provided by flowing said compressed stream through one or more heat exchange sections selected from the group consisting of the first heat exchange section, the second heat exchange section and the third heat-exchange section and wherein said stream is in indirect contact with and flows countercurrent to one or more of said refrigeration streams.

38. A process according to claim 37 wherein a portion of the cooling for step (hh) is provided by flowing said compressed stream through a second core wherein said core is situated in the kettle in the core-in-kettle heat exchanger of step (j).

39. An apparatus comprising:

(a) a compressor;

(b) a condenser;

(c) a core-in-kettle heat exchanger;

(d) a brazed aluminum plate fin heat exchange section comprised of two inlet and two outlet headers and a core which are situated to provide for the countercurrent flow of fluids;

(e) at least one refrigeration stage comprised of:

(i) a brazed aluminum plate fin heater exchange section comprised of inlet and outlet headers and a core providing for the flow of first and second fluid stream countercurrent to the flow of a third fluid stream;

(ii) a splitting means;

(iii) a pressure reduction means;

(iv) conduits providing for flow communication between the outlet header for the first stream and the splitting means, the splitting means and the pressure reduction means, the pressure reduction means and the inlet header for the third stream, the outlet header for the third stream and the compressor, and the splitting means and the inlet header for the first stream in the downstream plate fin heat exchange section in the next refrigeration stage or an inlet header for the plate fin heat exchange section of (d); and (v) a conduit connecting the outlet header for the second stream to the inlet header for the second stream in the downstream plate fin heat exchanger in the next refrigeration stage or to the entrance of the core in the core-in-kettle heat exchanger;

(f) a pressure reduction means;

(g) a conduit connecting the outlet header of the plate fin heat exchange section of (d) which is in flow communication with the inlet header of (iv) for said plate fin heat exchange section to the pressure reduction means and the pressure reduction means of (f);

(h) a means to insure flow communication between the pressure reduction means of (f) and the kettle-side of the core-in-kettle heat exchanger;

(i) a conduit connecting the kettle-side of the core-in-kettle heat exchanger to the remaining inlet header on the plate fin heat exchange section of (d);

(j) a conduit connecting the remaining outlet header on the plate fin heat exchange section of (d) to the compressor;

(k) a conduit connecting said outlet port on said compressor to the condenser;

(l) a conduit connecting said condenser to the inlet header on said brazed aluminum plate fin heat exchange section of (e) wherein said header is in flow communication with the outlet header of (iv);

(m) a conduit connected to the remaining inlet header for the initial refrigeration stage; and (n) a conduit connected to the exit end of the core in the core-in-kettle heat exchanger wherein said conduit passes through the kettle wall.

40. An apparatus according to claim 39 wherein said compressor is designed for hydrocarbon compression service.

41. An apparatus according to claim 39 wherein said hydrocarbon compression service is for the compression of ethane, ethylene or propane.

42. An apparatus for cooling a normally gaseous stream comprising:

(a) a two stage compressor;

(b) a refrigerant condenser;

(c) a first plate fin heat exchanger comprised of:

(i) first and second inlet headers and third and fourth outlet headers spatially located near one end of the plate fin heat exchanger;

(ii) first and second outlet headers and third and fourth inlet headers spatially located near the opposing end of that set forth in (i); and (iii) a core comprised of at least four flow conduits wherein the conduits respectively connect the first inlet header to the first outlet header, the second inlet header to the second outlet header, the third inlet header to the third outlet header and the fourth inlet header to the fourth outlet header;

(d) a second plate fin heat exchanger comprised of:

(i) a first inlet header and a second outlet headers spatially located near one end of the plate fin heat exchanger;

(ii) first outlet header and second inlet headers spatially located near the opposing end of that set forth in (i); and (iii) a core comprised of at least two flow conduits wherein the conduits respectively connect the first inlet header to the first outlet header and the second inlet header to the second outlet header;

(e) a first stream splitting means;

(f) a first and second pressure reduction means;

(g) a core-in-kettle heat exchanger;

(h) a first refrigerant conduit connecting the high stage outlet at the compressor to said refrigerant condenser;

(i) a second refrigerant conduit connecting said condenser to the first inlet header on said first plate fin heat exchanger;

(j) a third refrigerant conduit connecting the first outlet header in said first plate fin heat exchanger to the stream splitting means;

(k) a fourth refrigerant conduit connecting said stream splitting means to the first pressure reduction means;

(l) a fifth refrigerant conduit connecting said first pressure reduction means to the third inlet header in said first plate fin heat exchanger;

(m) a sixth refrigerant conduit connecting the third outlet header in said first plate fin heat exchanger to the high stage inlet port on the refrigerant compressor;

(n) a seventh refrigerant conduit connecting the splitting means to the first inlet header to said second plate fin heat exchanger;

(o) an eighth refrigerant conduit connecting the outlet header in said second plate fin heat exchanger to said second pressure reduction means;

(p) a connection means providing flow communication between said second pressure reduction means to the kettle-side of the core-in-kettle heat exchanger;

(q) a ninth refrigerant conduit connecting the kettle-side vapor outlet on the core-in-kettle heat exchanger to the second inlet header on said second plate-fin heat exchanger;

(r) a tenth refrigerant conduit connecting the second outlet header on the second plate fin heat exchanger to the fourth inlet header on said first plate fin heat exchanger;

(s) an eleventh refrigerant conduit connecting to the fourth outlet header in said first plate fin heat exchanger to the low stage inlet port on the compressor;

(t) a first conduit connected to the second inlet header on said first plant fin heat exchanger;

(u) a second conduit connecting the second outlet header on said first plate fin heat exchange to the inlet section of the core in said core-in-kettle heat exchanger; and (v) a third conduit connected to the outlet section of the core in said core-in-kettle heat exchanger and extending through the kettle wall of said core-in-kettle heat exchanger.

43. An apparatus according to claim 42 additionally comprising:

(w) a combining means situated in said second conduit; and (x) a first recycle conduit connected to said combining means.

44. An apparatus according to claim 42 wherein said two-stage compressor has inter-stage cooling.

45. An apparatus according to claim 42 wherein said compressor is designed for hydrocarbon compression service.

46. An apparatus according to claim 42 wherein said compressor is designed for propane, ethane or ethylene service.

47. An apparatus according to claim 42 wherein said compressor is designed for ethane or ethylene service.

48. An apparatus comprised of:

(a) a compressor;

(b) a condenser;

(c) a core-in-kettle heat exchanger;

(d) at least two pressure reduction means;

(e) a brazed aluminum plate fin heat exchanger comprised of:

(i) at least two inlet headers and at least one outlet header situated in close proximity to one another at or near one end of the plate fin heat exchanger;

(ii) a least one inlet header and at least one outlet header situated in close proximity to one another at or near the end opposing that set forth in (i);

(iii) at least one intermediate inlet header and at least one intermediate outlet header wherein said headers are situated along the exchanger between the headers of (i) and (ii); and (iv) a core comprised of:

(aa) at least one flow passage connecting one of said inlet headers of (i), an outlet header of (ii) and at least one intermediate outlet header of (iii);

(bb) at least one flow passage between one of the inlet headers of (ii) and either an intermediate outlet header of (iii) or an outlet header of (i);

(cc) at least one flow passage between one of said intermediate inlet headers of (iii) and at least one outlet header of (i); and (dd) at least one flow passage between the inlet header of (i) and either an intermediate outlet header of (iii) or an outlet header of (ii);

(f) conduit connecting the compressor to the condenser;

(g) conduit connecting the condenser to said inlet header of (i) which is in flow communication with at least one intermediate outlet header of (iii);

(h) conduits connecting each of the intermediate outlet header in flow communication with the inlet header employed in (g) to a pressure reduction means and connecting each pressure reduction means to an intermediate inlet header;

(i) conduits connecting the outlet headers of (i) and the headers of (bb) to the compressor;

(j) conduit connecting the outlet header of (ii) which is in flow communication with the intermediate outlet headers to a pressure reduction means;

(k) a means to insure flow communication between the pressure reduction means of (j) and the kettle-side of the core-in-kettle heat exchanger;

(l) conduit connecting said kettle-side of the core-in-kettle heat exchanger to one of said inlet headers employed in (bb);

(m) conduit connected to one of said remaining inlet headers of (i);

(n) conduit connecting the outlet header of (dd) or intermediate outlet header of (dd) which is in flow communication with the conduit of (m) to the core in the core-in-kettle heat exchanger; and (o) conduit connected to the exit section of the core in the core-in-kettle heat exchanger wherein said conduit extends external to the kettle.

49. An apparatus according to claim 48 wherein said compressor is designed for hydrocarbon compression service.

50. An apparatus according to claim 48 wherein said hydrocarbon compression service is for the compression of ethane, ethylene or propane.

51. An apparatus according to claim 48 further comprised of:

(p) one or more additional intermediate outlet headers situated between the intermediate headers of (iii) and the outlet headers of (ii) wherein said headers are connected to the passage of (aa);

(q) one or more additional intermediate inlet headers were one each of such headers are located on the plate fin heat exchanger in close proximity to an intermediate outlet header of (p);

(r) a conduit, pressure reduction means, and conduit providing flow communication between each header of (p) and (q) which are in spacial proximity to one another;

(s) for each intermediate inlet header of (q), an outlet header in close proximity to the headers of (i) or an intermediate outlet header situated along said plate fin heat exchanger between the header of (i) and said intermediate inlet header of (q); and (t) a core further comprised of passages connecting each such intermediate inlet header of (q) to the corresponding intermediate outlet header of (s), wherein the conduit of (I) is further comprised of such conduit necessary to connect the outlet headers of (s) to the compressor.

52. An apparatus according to claim 51 wherein said compressor is designed for hydrocarbon compression service.

53. An apparatus according to claim 52 wherein said hydrocarbon compression service is for the compression of ethane, ethylene, or propane.

54. An apparatus comprising:

(a) a two-stage compressor;

(b) a condenser;

(c) a brazed aluminum plate fin heat exchanger comprised of:

(i) first and second inlet headers and third and fourth outlet headers located in close proximity to one another near one end of the plate fin heat exchanger;

(ii) a second outlet header and a fourth inlet header located in close proximity to one another at the end opposing that set forth in (i);

(iii) first intermediate header, second intermediate header, and third intermediate header situated between said headers of (i) and (ii) on said plant fin heat exchanger; and (iv) a core within the plate fin heat exchanger comprised of at least one heat exchange conduit connecting the first inlet header and the first intermediate header, at least one heat exchange conduit connected the second inlet header to the second intermediate header and the second outlet header, at least one heat exchange conduit connecting the third intermediate header to the third outlet header, and at least one heat exchange conduit connected the fourth inlet header to the fourth outlet header;

(d) a first pressure reduction means;

(e) a second pressure reduction means;

(f) a core-in-kettle heat exchanger;

(g) a first refrigerant conduit connecting the high stage outlet port at the compressor to said refrigerant condenser;

(h) a second refrigerant conduit connected to said condenser to the second inlet header on said plate fin heat exchanger;

(i) a third refrigerant conduit connecting the second intermediate header to the first pressure reduction means;

(j) a fourth refrigerant conduit connecting the pressure reduction means to the third intermediate header;

(k) a fifth refrigerant conduit connecting the third outlet header to the second stage inlet port on the compressor;

(l) a sixth refrigerant conduit connecting said second outlet header to the second pressure reduction means;

(m) a means to insure flow communication between the pressure reduction means of (l) and the kettle-side of the core-in-kettle heat exchanger;

(n) at seventh refrigerant conduit connecting the kettle-side vapor outlet on the core-in-kettle heat exchanger and the fourth inlet header;

(o) an eighth refrigerant conduit connecting the fourth outlet head and the first stage inlet port on the compressor;

(p) a conduit connected to the first inlet header;

(q) a conduit connecting the first intermediate header to the inlet end of the core in the core-in-kettle heat exchanger; and (r) a conduit connected to the exit end of the core in the core-in-kettle heat exchanger.

55. An apparatus according to claim 54 additionally comprising:

(s) a combining means situated in said conduit between the first intermediate header and the core-in-kettle heat exchanger; and (t) first recycle conduit connected to said combining means.

56. An apparatus according to claim 54 wherein said compressor has inter-stage cooling.

57. An apparatus according to claim 54 wherein said compressor is designed for hydrocarbon compression service.

58. An apparatus according to claim 54 wherein said compressor is designed for propane, ethylene or ethane service.

59. An apparatus according to claim 54 wherein said compressor is designed for ethylene or ethane service.

60. An apparatus comprising:

(a) a two-stage compressor;

(b) a condenser;

(c) a brazed aluminum plate fin heat exchanger comprised of:

(i) first and second inlet headers and third and fourth outlet headers located in close proximity to one another near one end of the plate fin heat exchanger;

(ii) first and second outlet headers and fourth inlet header located in close proximity to one another at the end opposing that set forth in (i);

(iii) a second intermediate header and a third intermediate header wherein said headers are situated between the headers of (i) and (ii) on said plate fin heat exchanger; and (iv) a core within the plate fin heat exchanger comprised of at least one heat exchange conduit connecting the first inlet header and the first outlet header, at least one heat exchange conduit connected the second inlet header to the second intermediate header and the second outlet header, at least one heat exchange conduit connecting the third intermediate header to the third outlet header, and at least one heat exchange conduit connected the fourth inlet header to the fourth outlet header;

(d) a first pressure reduction means;

(e) a second pressure reduction means;

(f) a core-in-kettle heat exchanger;

(g) a first refrigerant conduit connecting the high stage outlet at the compressor to said refrigerant condenser;

(h) a second refrigerant conduit connected to said condenser and the second inlet header on said plate fin heat exchanger;

(i) a third refrigerant conduit connecting the second intermediate header to the first pressure reduction means;

(j) a fourth refrigerant conduit connecting the pressure reduction means to the third intermediate header;

(k) a fifth refrigerant conduit connecting the third outlet header to the second stage inlet port on the compressor;

(l) a sixth refrigerant conduit connecting said second outlet header to the second pressure reduction means;

(m) a means to insure flow communication between the pressure reduction means of (k) and the kettle-side of the core-in-kettle heat exchanger;

(n) at seventh refrigerant conduit connecting the kettle-side vapor outlet on the core-in-kettle heat exchanger and the fourth inlet header;

(o) an eighth refrigerant conduit connecting the fourth outlet head and the first stage inlet port on the compressor;

(p) a conduit connected to the first inlet header;

(q) a conduit connecting the first outlet header to the inlet end of the core in the core-in-kettle heat exchanger; and (r) a conduit connected to the exit end of the core in the core-in-kettle heat exchanger.

61. An apparatus according to claim 60 additionally comprising:

(s) a combining means situated in said conduit between the first outlet header and the core-in-kettle heat exchanger; and (t) a first recycle conduit connected to said combining means.

62. An apparatus according to claim 60 wherein said compressor is a two-stage compressor with inter-stage cooling.

63. An apparatus according to claim 60 wherein said compressor is designed for hydrocarbon compression service.

64. An apparatus according to claim 60 wherein said compressor is for ethylene or ethane service.

65. An apparatus comprising:

(a) a three-stage compressor;

(b) a condenser;

(c) a brazed aluminum plate fin heat exchanger comprised of (i) first-, second- and third-stream inlet headers and a fourth-stream outlet header located in close proximity to one another near one end of the plate fin heat exchanger;

(ii) a third-stream outlet header and sixth-stream inlet header located in close proximity to one another near the end opposing that set forth in (i);

(iii) third-, fourth- and fifth-stream intermediate headers of (iii) spatially located along the exchanger between the headers of (i) and (ii) and in spacial proximity to one another;

(iv) first-, second-, third-, fifth- and sixth-stream intermediate headers of (iv) spatially located along the exchanger between the headers of (iii) and the headers of (ii) and in spacial proximity to one another; and (v) a core within the plate fin heat exchanger comprised of at least one heat exchange conduit connecting the first-stream inlet header and the first-stream intermediate header of (iv), at least one heat exchange conduit connecting the second-stream inlet header and to the second-stream intermediate header of (iv); at least one heat exchange conduit connecting the third-stream inlet header, the third-stream intermediate header of (iii), the third-stream intermediate header of (iv) and the third-stream outlet header, at least one heat exchange conduit connecting the fourth-stream intermediate header to the fourth-stream outlet header, at least one heat exchange conduit connected the fifth-stream intermediate header of (iv) to the fifth-stream intermediate header of (iii), and at least one heat exchange conduit connecting the sixth-stream inlet header to the sixth stream intermediate header of (iv);

(d) first, second and third pressure reduction means;

(e) a core-in-kettle heat exchanger wherein said heat exchanger contains a first core and a second core;

(g) a first refrigerant conduit connecting the high stage outlet at the compressor to said refrigerant condenser;

(h) a second refrigerant conduit connecting said condenser to the third-stream inlet header on said plate fin heat exchanger;

(i) a third refrigerant conduit connecting the third-stream intermediate header of (iii) to the first pressure reduction means;

a fourth refrigerant conduit connecting the pressure reduction means to the fourth-stream intermediate header of (iii);

(k) a fifth refrigerant conduit connecting the fourth-stream outlet header to the third stage inlet port on the compressor;

(l) a sixth refrigerant conduit connecting the third-stream intermediate header of (iv) to the second pressure reduction means;

(m) a seventh refrigerant conduit connecting the pressure reduction means to the fifth-stream intermediate header of (iv);

(n) an eight refrigerant conduit connecting the fifth-stream intermediate header of (iii) to the to the second stage inlet port on the compressor;

(o) a ninth refrigerant conduit connecting said third stream outlet header to the third pressure reduction means;

(p) a means to insure flow communication between the pressure reduction means of (o) and the kettle-side of the core-in-kettle heat exchanger;

(q) at tenth refrigerant conduit connecting the kettle-side vapor outlet on the core-in-kettle heat exchanger and the sixth-stream inlet header;

(r) an eleventh refrigerant conduit connecting the sixth-stream intermediate header of (iv) to the first stage inlet port on the compressor;

(s) a conduit connected to the first inlet header;

(t) a conduit connecting the first intermediate header of (iv) and the inlet to the first core in the core-in-kettle heat exchanger;

(u) a conduit connected to the exit end of the first core in the core-in-kettle heat exchanger;

(v) a conduit connected to the second inlet header;

(w) a conduit connecting the second intermediate header of (iv) and the inlet to the second core in the core-in-kettle heat exchanger; and (x) a conduit connected to the exit end of the second core in the core-in-kettle heat exchanger.

66. An apparatus according to claim 65 wherein said compressor is designed for hydrocarbon compression service.

67. An apparatus according to claim 65 wherein said compressor is designed for propane service.

* * * * *